US007959514B2

(12) United States Patent
Chen et al.

(10) Patent No.: US 7,959,514 B2
(45) Date of Patent: Jun. 14, 2011

(54) OSCILLATING DEVICE FOR CHILDREN'S SWING APPARATUS

(75) Inventors: Hong-Bo Chen, Taipei (TW); Chih-Wei Wang, Taipei (TW)

(73) Assignee: Excellerate Enterprise Co., Ltd., Taipei (TW)

( * ) Notice: Subject to any disclaimer, the term of this patent is extended or adjusted under 35 U.S.C. 154(b) by 368 days.

(21) Appl. No.: 12/213,245

(22) Filed: Jun. 17, 2008

(65) Prior Publication Data

US 2009/0031495 A1 Feb. 5, 2009

(30) Foreign Application Priority Data

Aug. 1, 2007 (CN) ..... 2007 1 0141329
Mar. 21, 2008 (CN) ..... 2008 1 0086287

(51) Int. Cl.
*A63G 9/16* (2006.01)
*A63G 9/00* (2006.01)

(52) U.S. Cl. ..... 472/119

(58) Field of Classification Search ..... 472/118–125; 297/273, 274, 281
See application file for complete search history.

(56) References Cited

U.S. PATENT DOCUMENTS

| | | | | |
|---|---|---|---|---|
| 4,722,521 | A * | 2/1988 | Hyde et al. | 472/119 |
| 5,846,136 | A * | 12/1998 | Wu | 472/119 |
| 6,402,233 | B1 * | 6/2002 | Tseng | 297/184.1 |
| 6,471,597 | B1 * | 10/2002 | Flannery et al. | 472/119 |
| 6,544,128 | B1 * | 4/2003 | Yang | 472/119 |
| 6,626,766 | B1 * | 9/2003 | Hsia | 472/119 |
| 6,824,473 | B2 * | 11/2004 | Wu | 472/119 |
| 6,872,146 | B1 * | 3/2005 | Paesang et al. | 472/119 |
| 6,949,027 | B1 * | 9/2005 | Habing et al. | 472/118 |
| 7,275,996 | B2 * | 10/2007 | Dillner et al. | 472/119 |

* cited by examiner

*Primary Examiner* — Kien T Nguyen
(74) *Attorney, Agent, or Firm* — Bacon & Thomas, PLLC

(57) ABSTRACT

An oscillating device for a children's swing apparatus includes a base, a driving assembly mounted to the base, a first friction piece connected to the driving assembly, and a second friction piece operably driven by the first friction piece depending on a friction force therebetween. An elastic piece urges against one of the first friction piece and the second friction piece, a first shaft passes through a transmitting assembly, and an output member is operated by one of the first shaft and the second friction piece. The swing apparatus further includes a first frame supported on the ground, a second frame in which the sitting device is mounted such that the oscillating device connects the first frame to the second frame.

18 Claims, 22 Drawing Sheets

OSCILLATING DEVICE FOR CHILDREN'S SWING APPARATUS

FIELD OF THE INVENTION

The present invention generally relates to a swing apparatus for children and an oscillating device therein, and more particularly to a swing apparatus and an oscillating device driven by a friction piece.

BACKGROUND OF THE INVENTION

FIG. 1 is a partially assembled view which illustrates a conventional swing assembly 1 for children disclosed in U.S. Pat. No. 6,872,146 B1. The rotor of a motor 10 in the FIG. 1 is connected to a worm 11 which meshes with a worm gear 12. One end of a sliding rod 13 is pivotally connected to one side face of the worm gear 12 and another end of the sliding rod 13 is pivotally connected to a pivoting piece 14. The pivoting piece 14 is also used to secure one end of a spring 15.

When the motor 10 rotates, its movement is sequentially transmitted through the worm 11, the worm gear 12, the sliding rod 13 and the pivoting piece 14 to the spring 15. Because another end of the spring 15 contacts the a stopper 16, the restoration force resulting from deformation of the spring 15 is transmitted through the pivoting piece 14 and the sliding rod 13 to the worm gear 12 such that a swing rod 17 swings at a predetermined angle like a pendulum. Hence, a sitting device connected to the swing rod 17 at lower end thereof can be swung relative to a skeleton 18.

However, when the weight of the child in the sitting device exceeds the rated load of the motor 10, the sitting device is blocked by miscellaneous articles from being swung, or another child outside the sitting device intentionally holds the sitting device, the sitting device looks stationary but the motor 10 is still electrically active. Therefore, the motor 10 will be damaged due to overloaded current.

Besides, if outage happens or electric power is suddenly cut off when the sitting device is swung to a place other than the lowest position, the sitting device will fixedly stop at a relatively higher position immediately. This situation is similar to emergently braking a car, which causes the child in the sitting device to tilt forward or backward unexpectedly. In addition, the orientation of sitting device at that position makes the child therein uncomfortable Furthermore, the conventional swing assembly 1 is not equipped with a shielding device so that the conventional swing assembly 1 is not suitable for being used under the sun.

SUMMARY OF THE INVENTION

Accordingly, the present invention relates to a swing apparatus for children and an oscillating device therein that are substantially intended to obviate one or more of the problems due to the limitations and disadvantages encountered in the prior art.

One object of the present invention is to provide a swing apparatus for children and an oscillating device therein whose motor still can normally work to avoid from being damaged when the load on the seat frame exceeds rated capacity of the motor.

Another object of the present invention is to provide a swing apparatus for children and an oscillating device therein which can cushion the movement of the seat frame and avoid sudden stop of the seat frame when electric power is suddenly cut off.

Yet another object of the present invention is to provide a wing apparatus for children and an oscillating device therein which allow the seat frame to descend to a lower position when electric power is suddenly cut off.

Further object of the present invention is to provide a wing apparatus for children which is suitable for being used under the sun.

Additional features and advantages of the invention will be set forth in the description which follows, and in portion will be apparent from the description, or may be learned by practice of the invention. The objectives and advantages of the invention will be realized and attained by the structure as particularly set forth in the written description and claims as well as illustrated in the appended drawings.

These objects are achieved by an oscillating device as defined by the claim 1 and a swing apparatus as defined by the claims 11 and 17. The dependent claims define preferred or advantageous embodiments of the oscillating device and the swing apparatus.

The present invention provides an oscillating device used in combination with a swing apparatus. The oscillating device comprises a base; a driving assembly mounted to the base; an output piece pivotally connected to the base, the driving assembly operatably driving the output piece to oscillate relative to the base; and a transmitting assembly which includes a first friction piece, the first friction piece is driven to oscillate back and forth by the driving assembly and moves relative to or together with the output piece depending on a friction force therebetween.

Another aspect of the present invention is to provide a swing apparatus for children. The swing apparatus comprises a first frame, a second frame, and an oscillating device connecting the first frame with the second frame. The oscillating device includes: a base connected to the first frame; a driving assembly mounted to the base; an output piece pivotally connected to the base; and a transmitting assembly further including a first friction piece which is driven to oscillate back and forth by the driving assembly; whereby the first friction piece moves relative to or together with the output piece depending on a friction force therebetween, and the driving assembly operatably cooperates the second frame to swing relative to the first frame.

Further aspect of the present invention is to provide a swing apparatus for children. The swing apparatus comprises: a first frame; a second frame; and an oscillating device connecting the first frame with the second frame, the oscillating device includes a base connected to the first frame, a driving assembly mounted to the base, an output piece secured to the second frame pivotally connected to the base, a transmitting assembly mounted between the driving assembly and the output piece, and a first shaft connected to the driving assembly and passing through the transmitting assembly; wherein the transmitting assembly includes a first friction piece secured to the first shaft, and a second friction piece un-rotatably connected to output piece; when the first shaft is driven to rotate relative to the base by the driving assembly, the first friction piece is moved together with the first shaft, and the second friction piece is driven to rotate relative to the base by the friction between the first friction piece and the second friction piece so that the second frame is driven to oscillate back and forth relative to the first frame.

Moreover, the transmitting assembly includes a second friction piece which is for cooperating the output piece and an elastic piece which urges against one of the first friction piece and the second friction piece; the first friction piece moves relative to or together with the second friction piece depending on the friction force therebetween.

In a preferred aspect, the first friction piece includes a first rough face and the second friction piece includes a second rough face; the first rough face faces the second rough face.

It is another preferred feature that the first friction piece has a first friction face; the output piece has a second friction face which contacts the first friction face, the first friction face and the second friction face are cambered surfaces with different curvatures.

Additionally, the oscillating device comprises a first shaft which passes through the transmitting assembly and has a first plane; the first friction piece further includes a first central orifice adapted to the first plane; the first shaft is received in the first central orifice such that the first friction piece and the first shaft move together.

Furthermore, the driving assembly includes an actuator which is secured to the base, a driver which is connected to the actuator, a follower which is connected to the driver, and two links which are pivotally connected with each other and respectively connected to the follower and the first shaft; one of the two links includes a second central orifice adapted to the first plane; the first shaft is received in the second central orifice such that the one of the two links and the first shaft move together.

It is preferred that the transmitting assembly further includes a packing with two opposite side faces which respectively contact the first rough face and the second rough face.

It is preferred that the oscillating device further comprises a first shaft which passes through the transmitting assembly and has a first plane; the second friction piece further includes a third central orifice adapted to the first plane; the first shaft is received in the third central orifice such that the second friction piece and the first shaft move together.

It is preferred that the first shaft includes a second plane; the output piece includes a fourth central orifice adapted to the second plane; the first shaft is received in the fourth central orifice such that the first shaft and the output piece move together.

It is preferred that the driving assembly further includes an actuator which is secured to the base, a driver which is connected to the actuator, a follower which is connected to the driver, and a link which connects the follower to the first friction piece; the elastic piece urges against the first friction piece.

It is preferred that the transmitting assembly further includes a second friction piece which is for cooperating the second frame and an elastic piece which urges against one of the first friction piece and the second friction piece; the first friction piece moves relative to or together with the second friction piece depending on the friction force therebetween.

It is preferred that the swing apparatus further comprises a shielding device which is pivotally mounted to the oscillating device.

It is preferred that the oscillating device further comprises a first shaft which passes through the transmitting assembly and has a first plane; the first friction piece further includes a first central orifice adapted to the first plane; the first shaft is received in the first central orifice such that the first friction piece and the first shaft move together.

It is preferred that the oscillating device includes a second shaft and another base; the second shaft has a bent first section and the another base has two blockers; the bent first section moves between the two blockers so that the moving range of the second shaft and the output piece is restricted.

It is preferred that the driving assembly includes a sensor which is secured to the base, an actuator which is secured to the base for supplying power to the transmitting assembly, a driver which is connected to the actuator, a follower which is connected to the driver, and a link device which are pivotally connected to the follower and a first shaft which passes through the transmitting assembly, the sensor is configured to sense the movement of the link device so as to control the output of the actuator.

It is preferred that the first friction piece includes a first rough face and the second friction piece includes a second rough face; the transmitting assembly further includes a packing with two opposite side faces which respectively contact the first rough face and the second rough face.

The swing apparatus and the oscillating device according to the present invention has the following advantages: the motor will not be damaged due to overloaded current, the second frame may be gradually stopped, the sitting device may be stopped on a lower place when electric power is suddenly cut off, and the swing apparatus is also suitable for being utilized under the sun.

It is to be understood that both the foregoing general description and the following detailed description are exemplary and explanatory and are intended to provide a further non-limiting explanation of the invention as claimed.

BRIEF DESCRIPTION OF THE DRAWINGS

The accompanying drawings, which are included to provide a further understanding of the invention and constitute a portion of the specification, illustrate embodiments of the invention and together with the description serve to explain the principle of the invention. In the drawings.

DETAILED DESCRIPTION OF THE INVENTION

The First Preferred Embodiment

Figure 1:
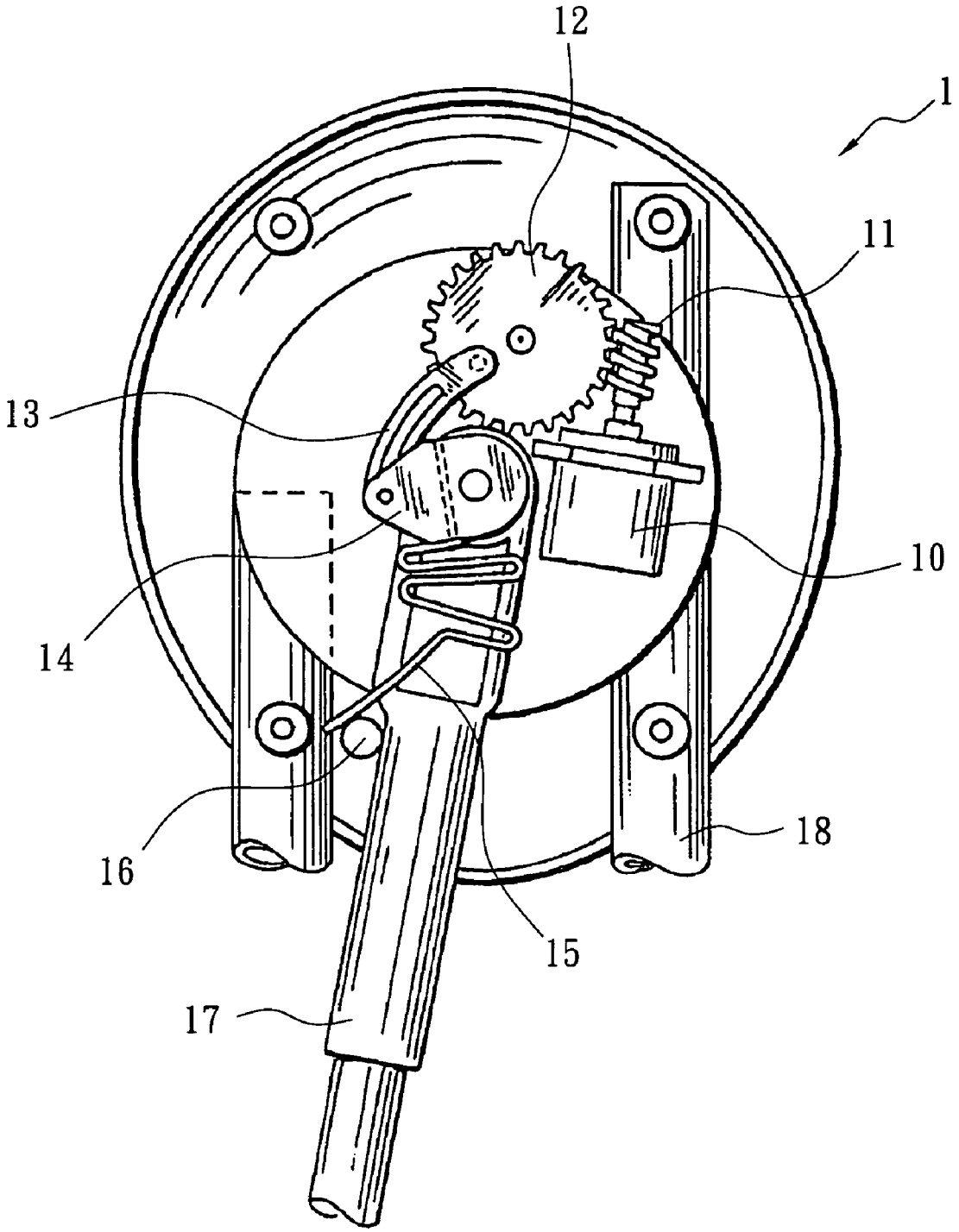
FIG. 1 Prior Art
FIG. 1 is a partially assembled view illustrating a conventional swing assembly.
Figure 2:
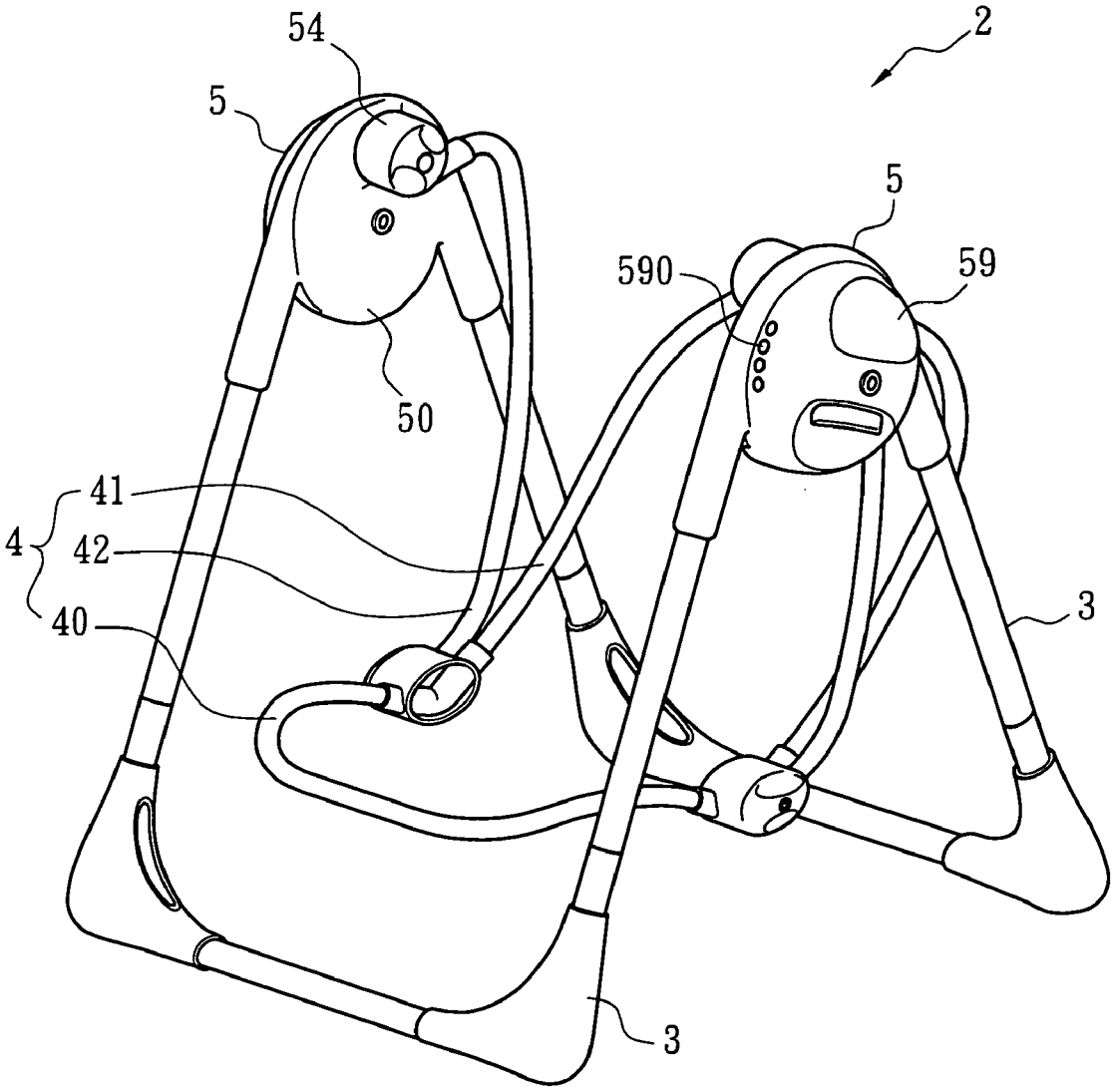
FIG. 2 is an assembled prospective view illustrating a swing apparatus for children according to the present invention.
Figure 3:
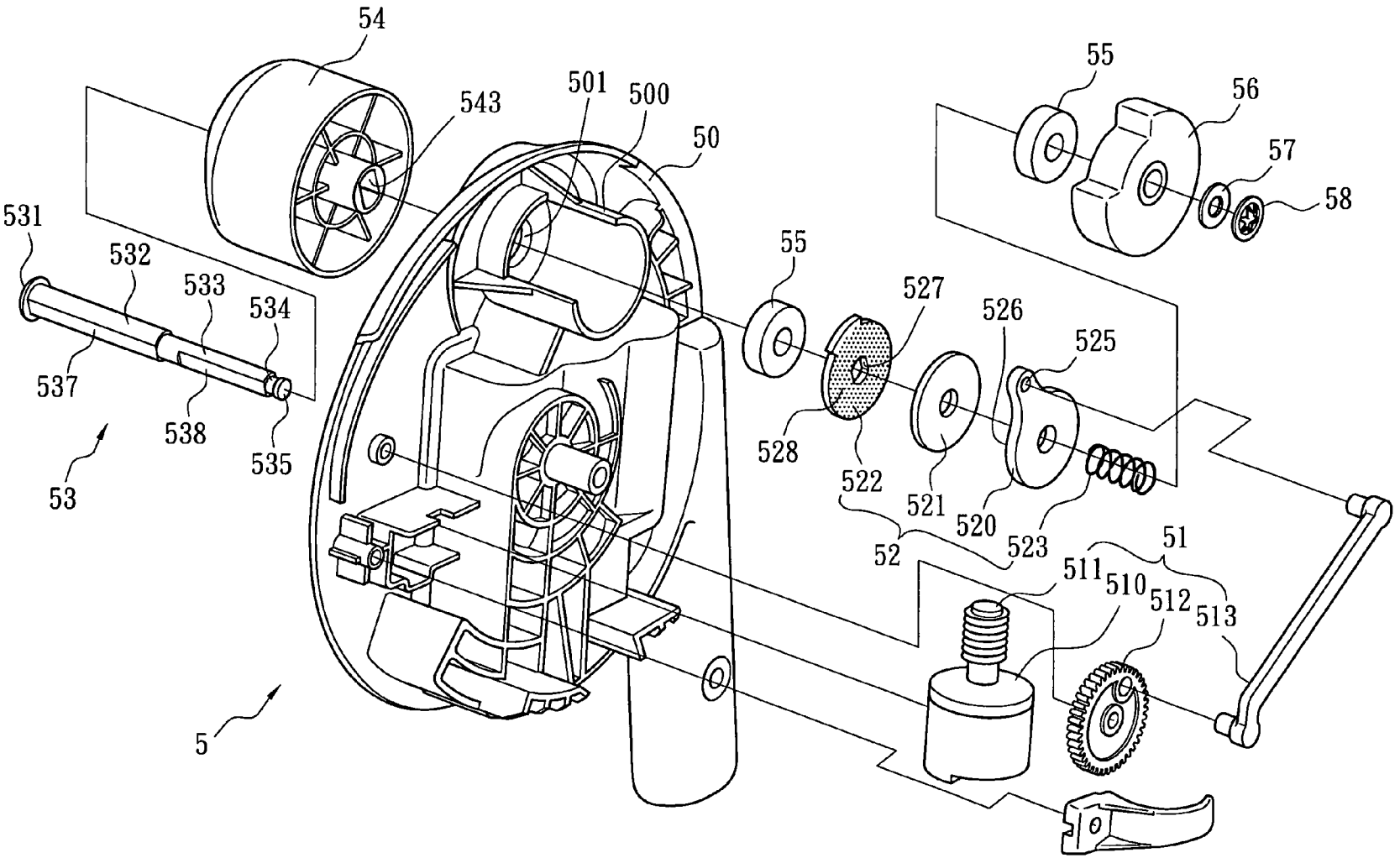
FIG. 3 is an exploded prospective view illustrating an oscillating device (without the first cover) in the swing apparatus according to the first preferred embodiment of the present invention.

As shown in FIGS. 2 and 3, the swing apparatus 2 for children according to the first preferred embodiment of the present invention comprises a first frame 3, a second frame 4 and an oscillating device 5. The first frame 3 may include two U-shaped frame bodies.

The oscillating device 5 connects the first frame 3 with the second frame 4. The second frame 4 may further include a seat portion 40, a backrest 41 and a hanger arm 42, which are connected with one another. Soft good or a sitting device (not shown) is fixed to the seat portion 40 and the backrest 41 for a child to sit in.

The oscillating device 5 includes a base 50, a driving assembly 51, a transmitting assembly 52, a first shaft 53, an output member 54, two supporting pieces (such as bearings) 55, a second cover 56, a washer 57, a retainer (such as a plum-blossom-shaped washer) 58 and a first cover 59.

The base 50 has a cuff 500 with about three-fourth circle near upper end and a hole 501 at the center of the circle.

The driving assembly 51 further includes an actuator (such as a motor) 510 fixed to the base 50, a driver (such as a worm) 511 connected to or used as the rotor of the actuator 510, a follower (such as a worm gear) 512 engaged with the driver 511, and a link 513.

The transmitting assembly 52 further includes an elastic piece (such as a spring) 523, a first friction piece 520, a packing 521 and a second friction piece 522, which are sequentially distributed.

The first friction piece 520 includes an ear 525 extending away from the circumference thereof, and a first rough face 526 situated at one side thereof.

The second friction piece 522 includes two opposite fourth planes 527 formed in the central orifice thereof, and a second rough face 528 situated at one side thereof.

The first shaft 53, according to the sizes of diameters, includes a first section 531 as a head portion, a second section 532 with two opposite second planes 537 within full length, a third section 533 with two opposite first planes 538 within partial length, a fourth section 534 with the smallest diameter, and a fifth section 535 as a tail portion.

Assembling

Figure 4:
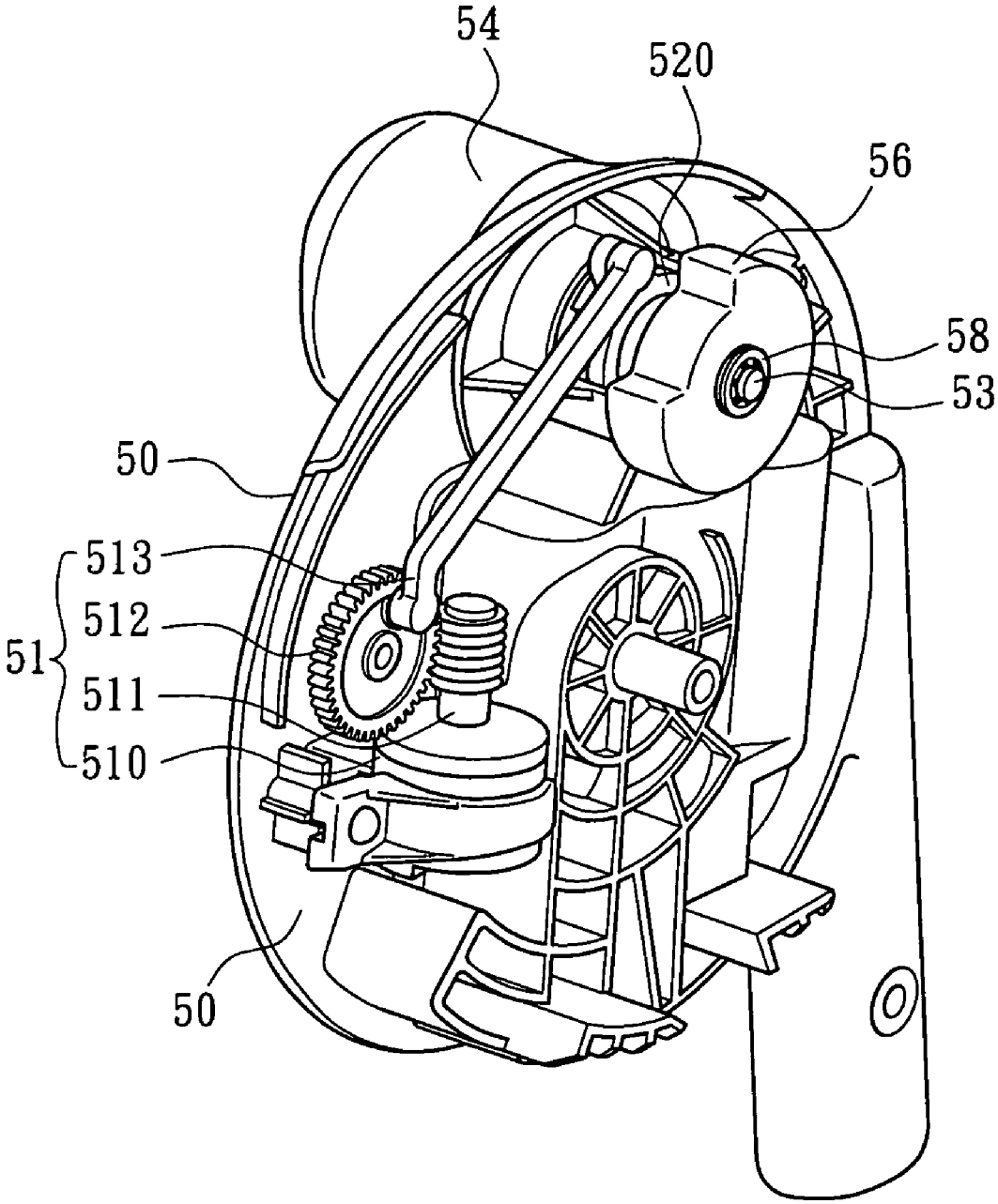
FIG. 4 is an assembled prospective view illustrating the oscillating device (without the first cover) in the swing apparatus according to the first preferred embodiment of the present invention.

As shown in FIGS. 3 and 4, the first shaft 53 is inserted into the output member 54 through the central orifice thereof first. Because the output member 54 has two opposite third planes 543 in the central orifice thereof, the second planes 537 of the second section 532 will abut against the third planes 543 so that the output member 54 and the first shaft 53 are unable to rotate relative to each other.

Next, the subassembly of the output member 54 and the first shaft 53 is mounted to the base 50. Specifically, The third section 533 of the first shaft 53 passes through the hole 510 of the upper portion of the base 50 so that the output member 54 and the third section 533 of the first shaft 53 are respectively situated at two opposite sides of the base 50.

Thereafter, one of the supporting pieces 55 is put into the cuff 500 and sleeved on the first shaft 53 at the third section 533 other than the first planes 538. Subsequently, the second friction piece 522, the packing 521, the first friction piece 520, elastic piece 523, another supporting piece 55, the second cover 56, and the washer 57, each with a central orifice, are sequentially sleeved on the third section 533 at the portion of the first planes 538. Among the elements sleeved on the first planes 538, only the second friction piece 522 is provided with two opposite fourth planes 527 within the central orifice thereof, which aims at being engaged with the first planes 538 of the first shaft 53. In view of this, the second friction piece 522 and the first shaft 53 is unable to rotate relative to each other while the packing 521, the first friction piece 520 and the elastic piece 523 can rotate relative to the first shaft 53.

Finally, the retainer 58 is snapped on the first shaft 53 at the fourth section 534 such that all elements sleeved on the first shaft 53 cannot be released from the first shaft 53 and the base 50.

On the other hand, the actuator 510 is secured to the base 50 at the lower portion. After that, the follower 512 is pivotally connected to the base 50 and engaged with the driver 511.

Then, two ends of the link 513 are pivotally connected respectively to the other side of the follower 512 and the ear 525 of the first friction piece 520.

Moreover, the first cover 59 with electric switches 590 is installed to the base 50 and thus the assembling about the oscillating device 5 in the swing apparatus 2 for children is accomplished.

As shown in the FIG. 2, if the first frame 3 is further mounted below the base 50 and the hanger arm 42 of the second frame 4 is fastened to the output member 54, then the swing apparatus 2 for children according to the present invention is totally assembled. Incidentally, the swing apparatus 2 may be equipped with, for example, only one complete oscillating device 5 at one side of the swing apparatus 2, i.e., another oscillating device 5 at another side of the swing apparatus 2 does not include the driving assembly 51 and the transmitting assembly 52.

Operation and Effect

Figure 5:
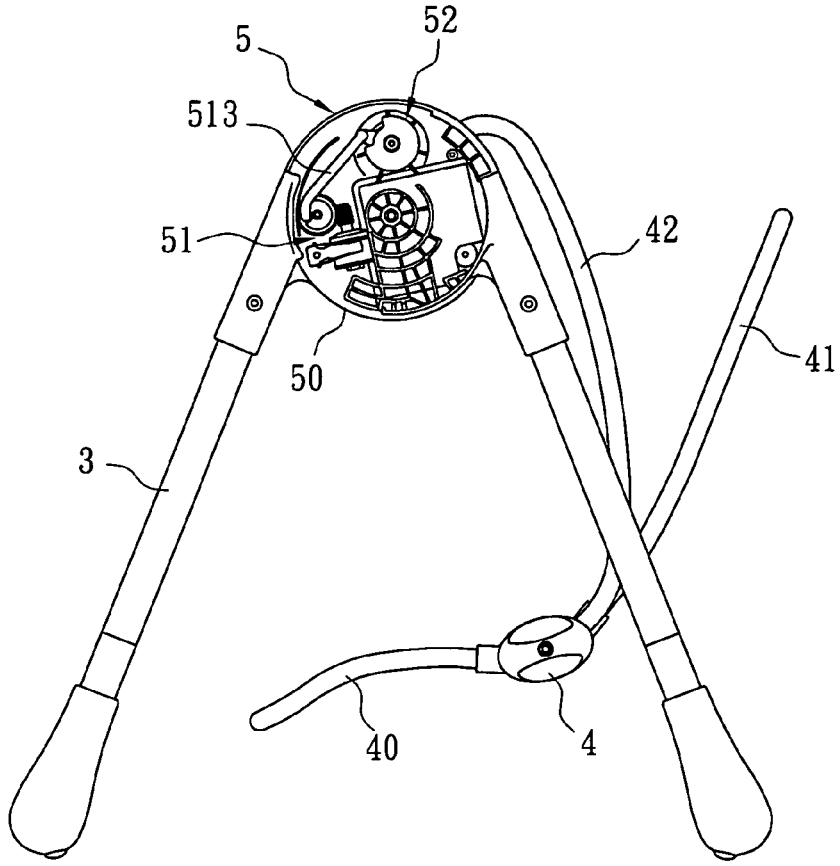
FIG. 5 is an assembled side view illustrating the swing apparatus (without the first cover) according to the first preferred embodiment of the present invention, wherein the second frame is swung to a first (back) position.
Figure 6:
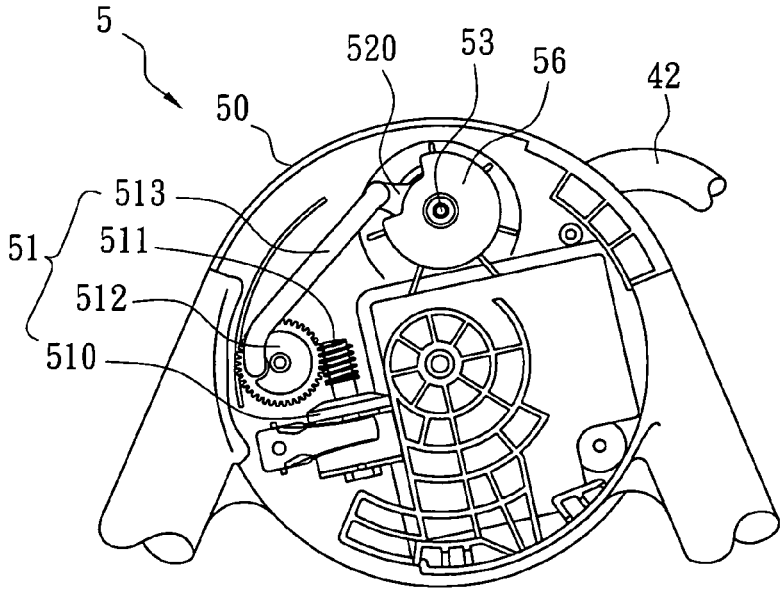
FIG. 6 is an enlarged view illustrating the oscillating device in the FIG. 5.

As shown in FIGS. 3, 5 and 6, when one of the electric switches 590 (FIG. 2) is pressed, electric current flows through electric circuit (not shown) to start the actuator 510. The movement of the actuator 510 is sequentially transmitted to the driver 511, the follower 512, link 513, and the first friction piece 520. In the meantime, the follower 512 continuously rotates in one direction while the first friction piece 520 can only repeatedly oscillates within a predetermined angular range.

Furthermore, since the first rough face 526 of the first friction piece 520 and the second rough face 528 of the second friction piece 522 respectively face two sides of the packing 521, the first friction piece 520 and the second friction piece 522 will tightly abut respectively against the two side faces of the packing 521 due to elastic force of the elastic piece 523. Consequently, the oscillating movement of the first friction piece 520 can be transmitted to the packing 521 and further to the second friction piece 522 by means of the friction forces existing on the faces contacting each other. When the load, which may include weights of the second frame 4, sitting device, child and miscellaneous articles, on the second frame 4 is smaller than the friction force in the transmitting assembly 52, the first friction piece 520, the packing 521 and the second friction piece 522 shall not rotate relatively one another.

Figure 7:
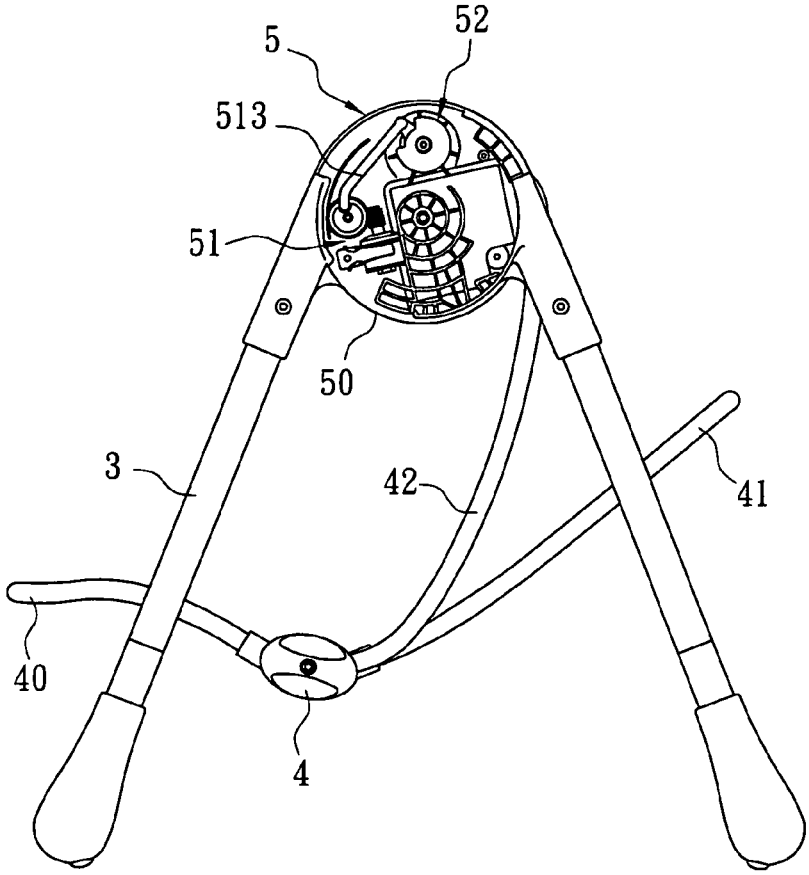
FIG. 7 is an assembled side view illustrating the swing apparatus (without a first cover) according to the first preferred embodiment of the present invention, wherein the second frame is swung to a second (forth) position.
Figure 8:
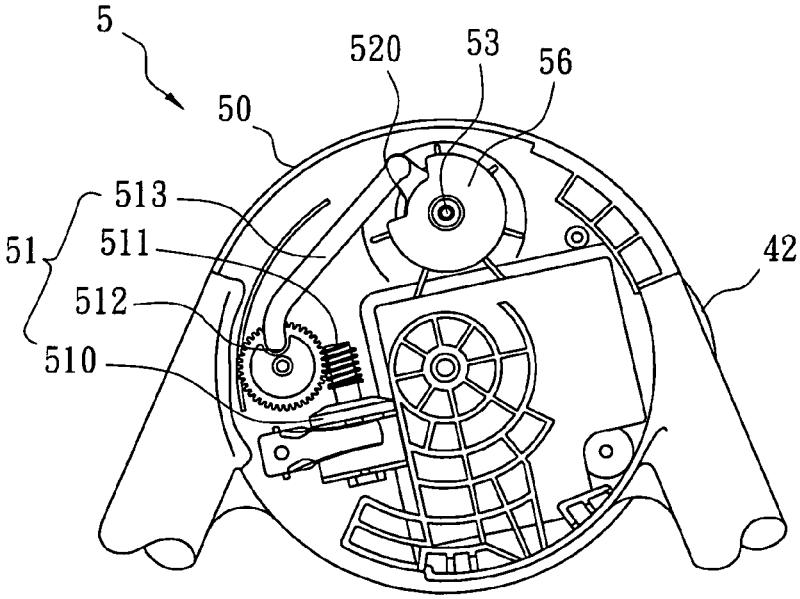
FIG. 8 is an enlarged view illustrating the oscillating device in the FIG. 7.

Because the fourth plane 527 of the second friction piece 522 matches the first plane 538 of the first shaft 53, oscillating movement of the second friction piece 522 can be transmitted to the first shaft 53. Similarly, the movement of the first shaft 53 can be transmitted to the output member 54 since the second plane 537 of the first shaft 53 matches the third plane 543 of the output member 54. The output member 54 is allowed to oscillate relative to the base 50 and then the movement of the output member 54 is transmitted to the second frame 4 via the hanger arm 42. As a result, the second frame 4 and the sitting device thereon can swing back and forth within a predetermined angular range, such as the first (back) position illustrated in the FIG. 5 and the second (forth) position illustrated in the FIG. 7. Incidentally, the two supporting pieces 55 are used to support the first shaft 53 respectively at two ends thereof to help the oscillation movement smoother.

In the transmitting assembly 52 of the present invention, the first rough face 526, the packing 521 and the second rough face 528 have friction coefficients depending on material and roughness thereof so that when the elastic piece 523 applies normal force to the first friction piece 520, there are friction forces on the contacting faces during oscillating movement. Therefore, if the load on the second frame 4 is smaller than the maximum static friction force on the contacting faces, the movement of the driving assembly 51 can be transmitted through the transmitting assembly 52 to the output member 54 so as to swing the second frame 4. Specifically, when the load on the second frame 4 is smaller than the maximum static friction force between the first friction piece 520 and the packing 521, the link 513 drives the first friction piece 520 and then the first friction piece 520 frictionally drives the packing 521 via the friction force. When the load on the second frame 4 is also smaller than the maximum static friction force between the packing 521 and the second friction piece 522, the packing 521 also frictionally drives the second friction piece 522 via the friction force. The second friction piece 522 further cooperates the first shaft 53 so that the output member 54 is co-moved by the first shaft 53.

On the contrary, when the load on the second frame 4 is larger than the maximum static friction force among the first rough face 526, the packing 520 and the second rough face 528, then the first friction piece 520 will rotate relative to the packing 521 and/or the packing 521 will rotate relative to the second friction piece 522. In other words, the second friction piece 522 is stationary. In this case, although the driving assembly 51 continuously operates, the movement thereof can only be transmitted to the first friction piece 520 or even to the packing 521 but by no means to the second friction piece 522. Hence, the second friction piece 522, the first shaft 53, the output member 54 and the second frame 4 are all stationary. Because the actuator 510 is kept in normally operating state at this time, it will not break down due to overload.

In another aspect, if blackout happens or the power is suddenly switched off during oscillation of the second frame 4, on the ground that resultant force of the normal load and inertia force of the second frame 4 is larger than the maximum friction force, the first friction piece 520, the packing 521 or the second friction piece 522 may rotate relatively one another so that the second frame 4 may swing further by a small angle rather than suddenly stop like emergently braking a car. Besides, the maximum static friction force on the contacting faces turns into smaller kinetic friction force, which may be also smaller than the load on the second frame 4, such that the second friction piece 522 perhaps rotate relative to the packing 521 or the first friction piece 520 due to the load itself on the second frame 4 and thus the second frame 4 may gradually descend near the lowest position.

The material of the packing 521 may be rubber, the packing 521 may be omitted from the transmitting assembly 52 in another embodiment, and the first and second friction pieces 520, 522 may be respectively made of different materials, all of which can achieve the objects and effects according to the present invention.

The Second Preferred Embodiment

The difference between the swing apparatuses 2 of the first and second preferred embodiments of the present application only exists in some structure and assembling process of the oscillating device 5. As to the first frame 3 and the second frame 4, the two embodiments have the same structure and assembling process. Therefore, only the difference is described in the following second embodiment.

Figure 9:
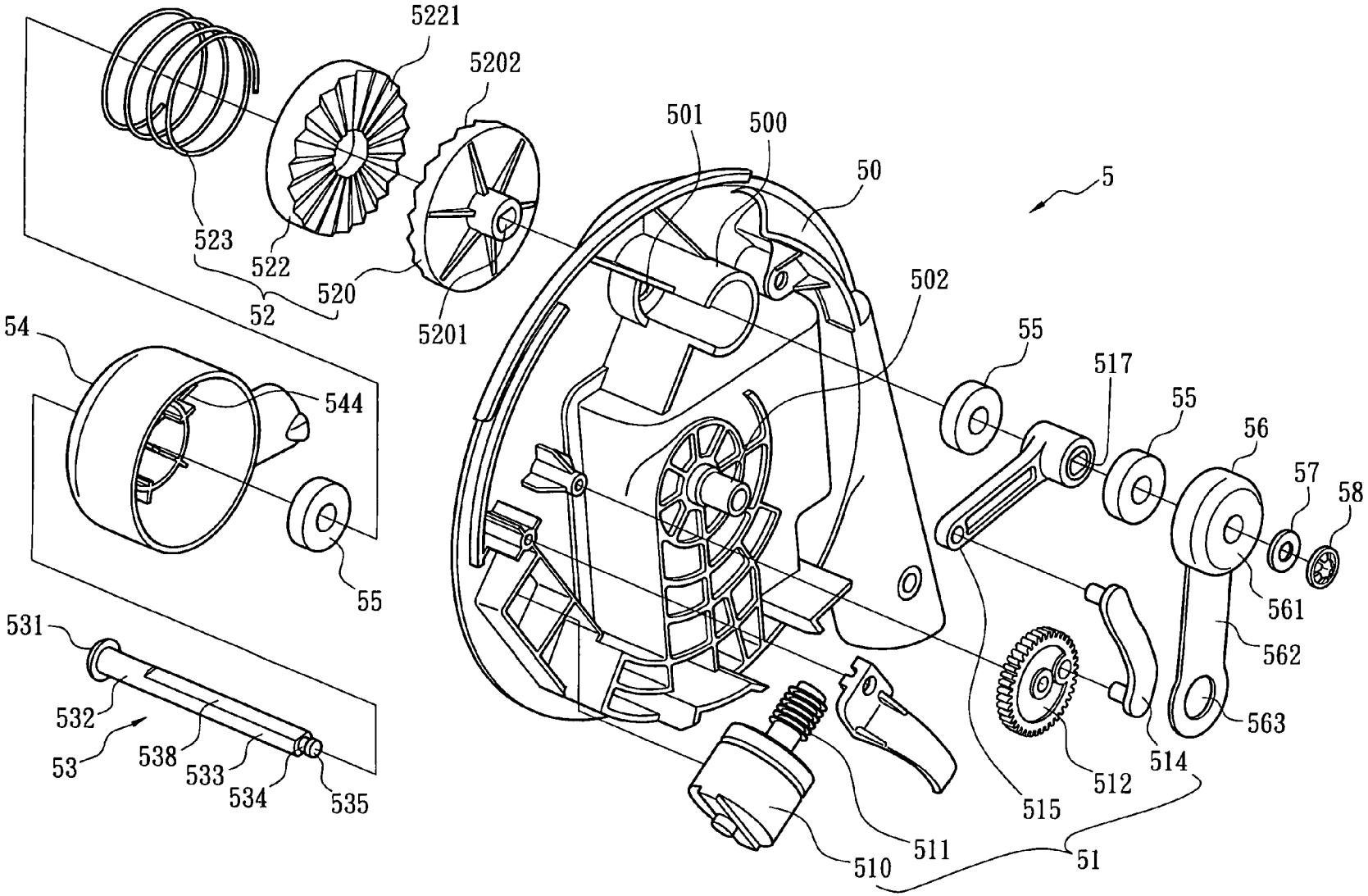
FIG. 9 is an exploded prospective view illustrating an oscillating device (without the first cover) in the swing apparatus according to the second preferred embodiment of the present invention.

As shown in the FIG. 9, the oscillating device 5 in the second preferred embodiment includes a base 50, a driving assembly 51, a transmitting assembly 52, a first shaft 53, an output member 54, three supporting pieces (such as bearings) 55, a second cover 56, a washer 57, a retainer (such as a plum-blossom-shaped washer) 58 and a first cover 59 (FIG. 2).

The base 50 has a cuff 500 with about three-fourth circle near upper end, a hole 501 at the center of the circle, and a pillar 502 formed at the center of the base 50.

The driving assembly 51 includes an actuator (such as a motor) 510 fixed to the base 50, a driver (such as a worm) 511 connected to or used as the rotor of the actuator 510, a follower (such as a worm gear) 512 engaged with the driver 511, a first link 514 pivotally connected to the follower 512, and one end of a second link 515 pivotally connected to the first link 514. The second link 515 at the other end thereof has a bore and two opposite sixth planes 517 within the bore.

Figure 10:
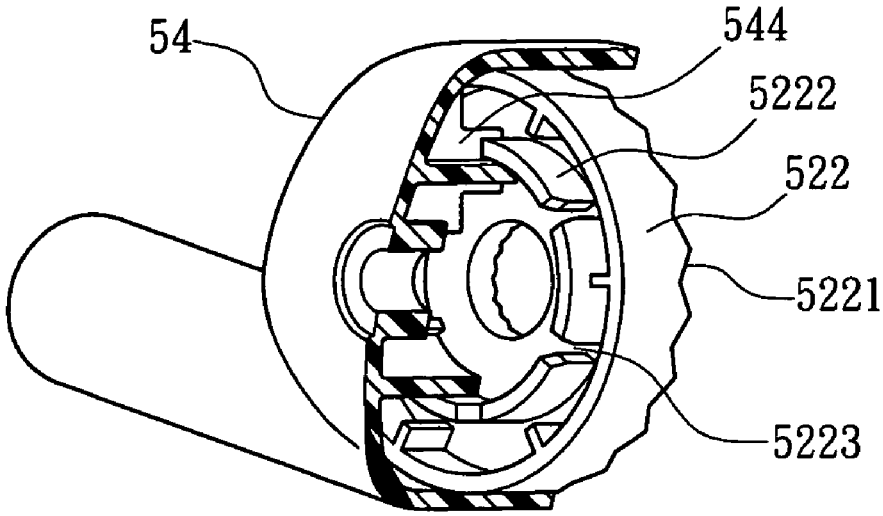
FIG. 10 is an assembled prospective view illustrating the second friction piece and output member shown in the FIG. 9.

The transmitting assembly 52 includes a first friction piece 520, a second friction piece 522 and an elastic piece (such as a spring) 523, which are sequentially distributed. The first friction piece 520 has two opposite fifth planes 5201 formed in the central orifice thereof and a first tooth face 5202 (functioning as the first rough face) formed on one side face thereof. The second friction piece 522 has a second tooth face 5221 (functioning as the second rough face) formed on one side face thereof, a plurality of flanges 5222 (FIG. 10) extending from opposite side thereof and distributed in a ring shape, and a plurality of slots 5223 (FIG. 10) respectively defined by any two adjacent flanges 5222. Both the first tooth face 5202 and second tooth face 5221 have a plurality of crown teeth distributed radically.

The first shaft 53, according to the sizes of diameters, includes a first section 531 functioning as a head portion, a second section 532 without any plane within full length, a third section 533 with two opposite first planes 538 within full length, a fourth section 534 with the smallest diameter, and a fifth section 535 functioning as a tail portion. The second section 532 and the cylindrical portion of the third section 533 have the same diameter.

Figure 11:
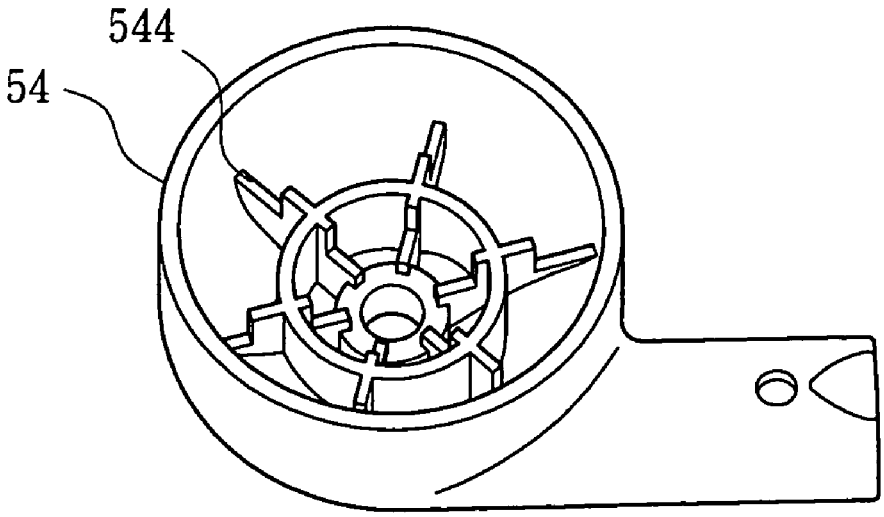
FIG. 11 is a prospective view illustrating the output member shown in the FIG. 9.

The output member 54 has a plurality of ribs 544 (FIG. 11) radically distributed around the central orifice thereof but there is no the third plane 543 in the first embodiment within the central orifice.

The second cover 56 includes a cap 561, a plate 562 extending away from the cap 561, and an aperture 563 formed in the free end of plate 562.

Assembling

At first, the first shaft 53 is inserted into the output member 54 through the central orifice thereof. Next, the first supporting piece 55, the elastic piece 523, the second friction piece 522 and the first friction piece 520 are sequentially sleeved on the first shaft 53 such that two ends of the elastic piece 523 respectively urge against the output member 54 and the second friction piece 522 at its side with the flange 5222, and such that the second tooth face 5221 of the second friction piece 522 abuts against the first tooth face 5202 of the first friction piece 520. Thereafter, the first shaft 53 in the subassembly described above is inserted into the hole 501 of the base 50 so that the output member 54, the first supporting piece 55, the elastic piece 523, the second friction piece 522 and the first friction piece 520 are positioned at one side of the base 50, while part of the third section 533, the fourth section 534 and the fifth section 535 of the first shaft 53 are situated at another side of the base 50 and received within the cuff 500.

Subsequently, the second supporting piece 55, one end of the second link 515 with the sixth plane 517, the third supporting piece 55, the cap 561 of the second cover 56, the washer 57 and the retainer 58 are sequentially sleeved on the first shaft 53. Among the elements that are mounted on the first shaft 53, except that the output member 54 and the first supporting piece 55 are sleeved on the second section 532 of the first shaft 53 and the retainer 58 clips the first shaft 53 at the fourth section 534, the others are sleeved on the first shaft 53 at the third section 533. In addition, the pillar 502 of the base 50 is accommodated within the aperture 563 of the second cover 56.

Nevertheless, among the elements that are mounted on the first shaft 53, only the second link 515 with the sixth plane 517 and the first friction piece 520 with the fifth plane 5201 abut against the first plane 538 of the first shaft 53. Accordingly, the first shaft 53 will always move together with the second link 515 as well as the first friction piece 520. As far as the other elements mounted on the first shaft 53, because they have no planes to abut against the first plane 538 of the first shaft 53, the first shaft 53 can rotate relative to them.

On the other hand, the actuator 510 is secured to the lower portion of the base 50. After that, the follower 512 is pivotally connected to the base 50 and engaged with the driver 511. Then, two ends of the first link 514 are pivotally connected respectively to a side face of the follower 512 and another end of the second link 515.

Moreover, the first cover 59 with the electric switches 590 is installed to the base 50 and secured to the pillar 502. The assembling about the oscillating device 5 in the swing apparatus 2 for children is now accomplished.

Operation and Effect

Figure 12:
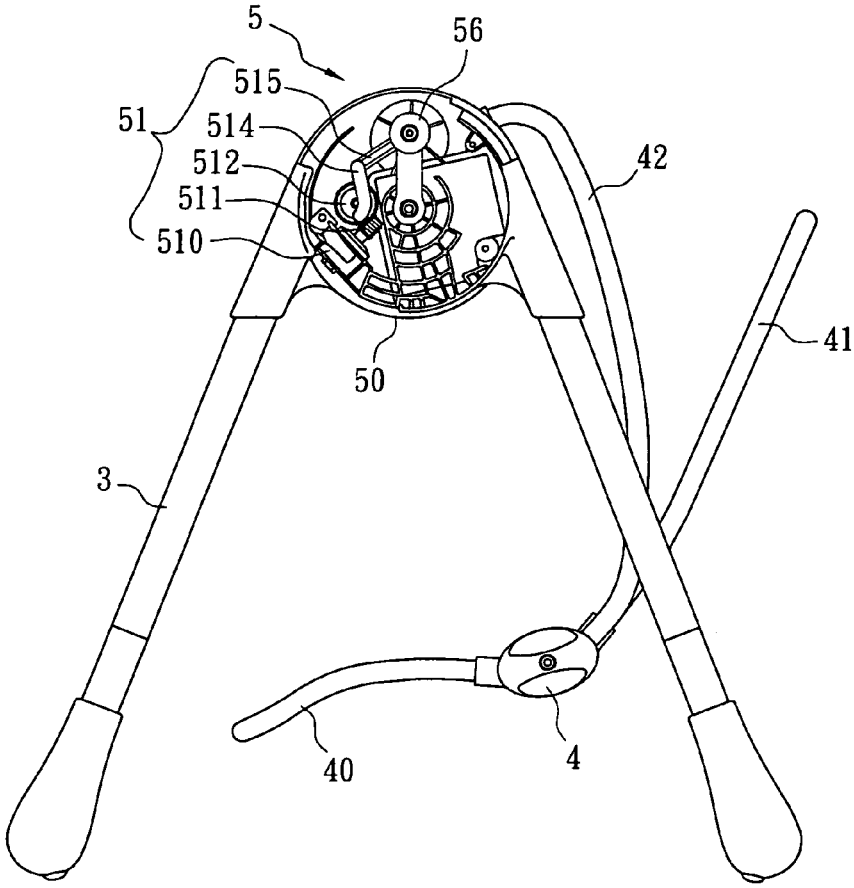
FIG. 12 is an assembled side view illustrating the swing apparatus (without the first cover) according to the second preferred embodiment of the present invention, wherein the second frame is swung to a first (back) position.
Figure 13:
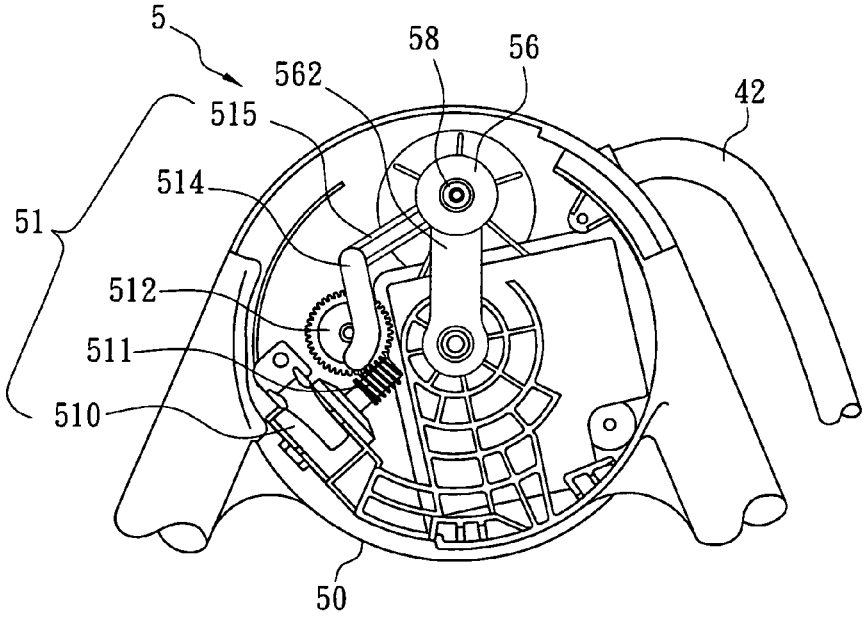
FIG. 13 is an enlarged view illustrating the oscillating device in the FIG. 12.

As shown in FIGS. 9, 12 and 13, when one of the electric switches 590 (FIG. 2) is pressed, electric current flows through electric circuit (not shown) to start the actuator 510. The movement of the actuator 510 is sequentially transmitted to the driver 511, the follower 512, the first link 514, the second link 515, the first shaft 53 and the first friction piece 520. In the meantime, the follower 512 continuously rotates in one direction while the first friction piece 520 can only repeatedly oscillates within a predetermined angular range.

Figure 14:
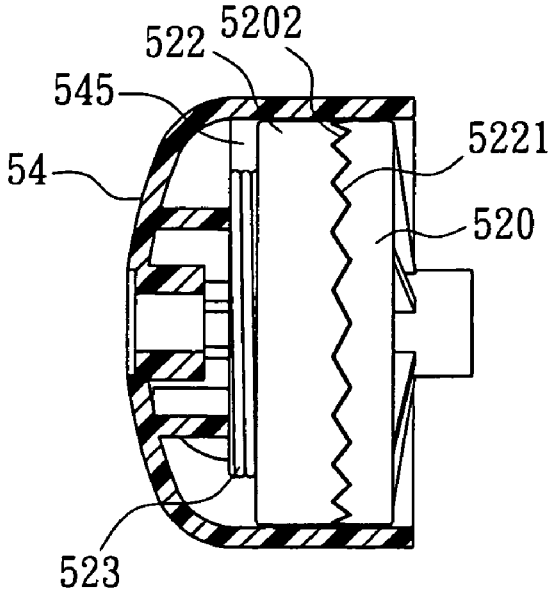
FIG. 14 is a side view illustrating the first friction piece meshes the second friction piece shown in the FIG. 9.

Furthermore, the corresponding crown teeth on the first tooth face 5202 of the first friction piece 520 and the second tooth face 5221 of the second friction piece 522 will tightly mesh each other due to elastic force of the elastic piece 523. Specifically, as shown in the FIG. 14, the tooth ends and root ends on the first tooth face 5202 of the first friction piece 520 respectively abut against the root ends and tooth ends on the second tooth face 5221 of the second friction piece 522, and the tooth flanks on the first tooth face 5202 abut against the tooth flanks on the second tooth face 5221. Consequently, when the load, which may includes weights of the second frame 4, sitting device, child and miscellaneous articles, on the second frame 4 is smaller than the meshing force of friction force between corresponding crown teeth in the transmitting assembly 52, the first friction piece 520 and the second friction piece 522 cannot rotate relative to each other so that the movement of the first friction piece 520 can be transmitted to the second friction piece 522. Furthermore, because the ribs 544 of the output member 54 are respectively accommodated within the slots 5223 on another side face of the second friction piece 522 and almost abut against the flanges 5222 (FIG. 10), the movement of the second friction piece 522 can be transmitted to the output member 54.

Figure 16:
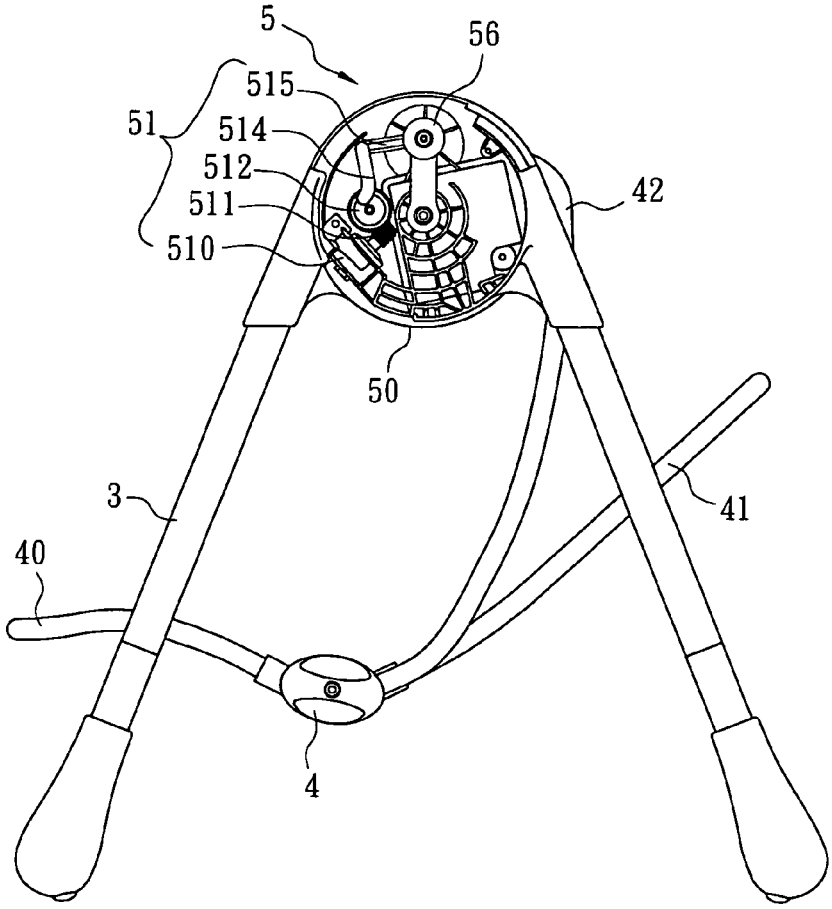
FIG. 16 is an assembled side view illustrating the swing apparatus (without the first cover) according to the second preferred embodiment of the present invention, wherein the second frame is swung to a second (forth) position.
Figure 17:
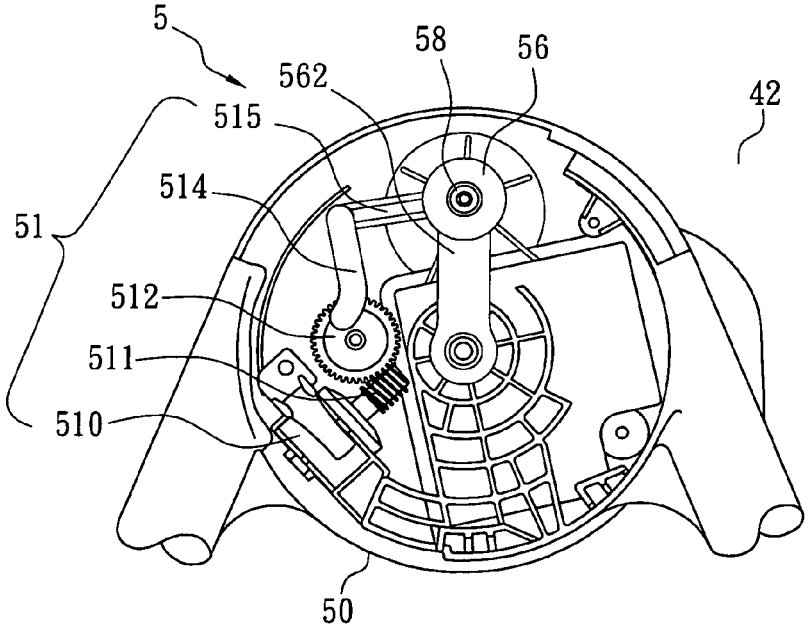
FIG. 17 is an enlarged view illustrating the oscillating device in the FIG. 16.

The output member 54 can rotate relative to the base 50. The oscillation movement of the output member 54 can be transmitted to the second frame 4 via the hanger arm 42 in order to make the second frame 4 and the sitting device secured thereon swing back and forth within a predetermined angular range, such as the first (back) position illustrated in the FIG. 12 and the second (forth) position illustrated in the FIG. 16. Incidentally, the three supporting pieces 55 are used to support the first shaft 53 respectively at two ends and middle portion thereof to help the oscillation movement smoother.

Figure 15:
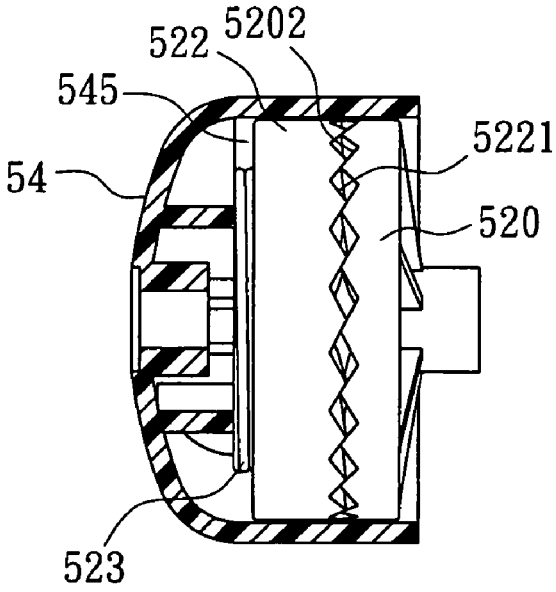
FIG. 15 is a side view illustrating the first friction piece does not mesh the second friction piece shown in the FIG. 9.

On the contrary, when the load on the second frame 4 is larger than the meshing force or maximum static friction force between the first tooth face 5202 and the second tooth face 5221, then the first friction piece 520 will rotate relative to the second friction piece 522. In other words, as shown in the FIG. 15, the tooth flanks on the first tooth face 5202 slide relative to the tooth flanks on the second tooth face 5221 to the extent that the tooth ends on the first tooth face 5202 contact the tooth ends on the second tooth face 5221. At the same time, the second friction piece 522 is further pressed into the output member 54, i.e., the ribs 544 of the output member 54 are further inserted into the slots 5223 in the second friction piece 522, so that the gap 545 between the second friction piece 522 and the output member 54 is decreased. When the first friction piece 520 keeps rotating, the states shown in the FIGS. 14 and 15 alternatively appear such that the second friction piece 522 can only slide back and forth along the first shaft 53 but cannot rotate together with the first shaft 53. In this case, although the driving assembly 51 continuously operates, the movement thereof can only be transmitted through the first shaft 53 to the first friction piece 520 to make the first friction piece 520 swing within a predetermined angular range. Instead, the second friction piece 522 can only reciprocate in the axial direction of the first shaft 53 within a short distance but cannot be rotated by the first friction piece 520. As to the output member 54 and the second frame 4 are all stationary. Because the actuator 510 is kept in normally operating state at this time, it will not break down due to overload.

In another aspect, if blackout happens or the power is suddenly switched off during oscillation of the second frame 4, on the ground that resultant force of the normal load and inertia force of the second frame 4 is larger than the meshing force or maximum static friction force between the first tooth face 5202 and the second tooth face 5221, the second friction piece 522 may rotate relative to the first friction piece 520 a little bit regardless of the stop of the first friction piece 520. Therefore, the second frame 4 may swing further by a small angle rather than suddenly stop like emergently braking a car. Besides, the maximum static friction force on the tooth flanks of the crown teeth turns into smaller kinetic friction force, which may be also smaller than the load on the second frame 4, such that the second friction piece 522 perhaps rotate relative to the first friction piece 520 due to the load itself on the second frame 4 and thus the second frame 4 may gradually descend to the lower position.

The Third Preferred Embodiment

The difference between the swing apparatuses 2 of the third and second preferred embodiments of the present application only exists in some structure and assembling process of the oscillating device 5. As to the first frame 3 and the second frame 4, their structure and assembling process are the same as those in the first and second embodiments. Therefore, only the difference is described in the following third embodiment.

Figure 18:
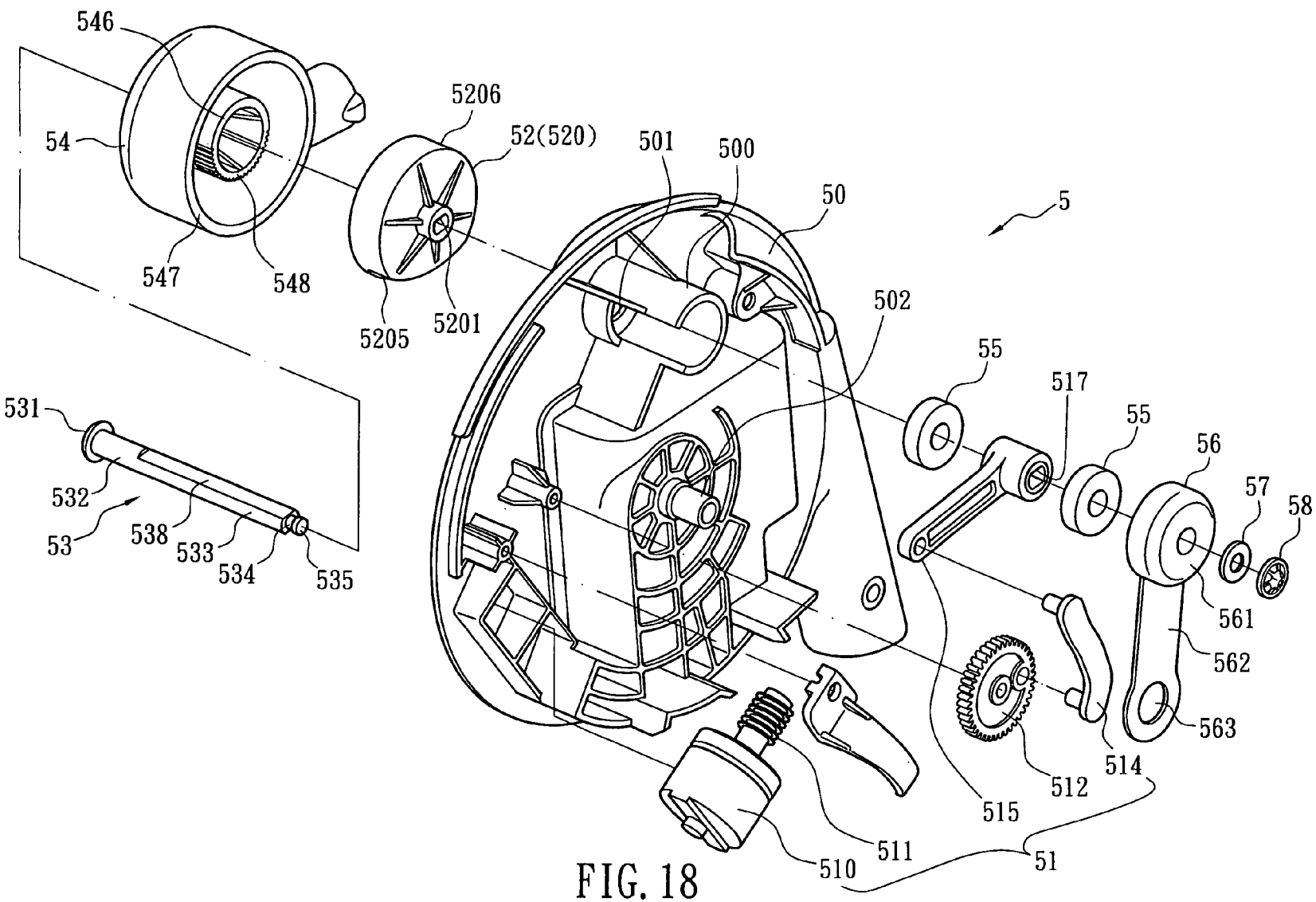
FIG. 18 is an exploded prospective view illustrating an oscillating device (without the first cover) in the swing apparatus according to the third preferred embodiment of the present invention.

As shown in the FIG. 18, the oscillating device 5 in the third embodiment includes a base 50 (the same as that in the FIG. 9), a driving assembly 51 (the same as that in the FIG. 9), a transmitting assembly 52, a first shaft 53 (the same as that in the FIG. 9), an output member 54, two supporting pieces (such as bearings) 55 (FIG. 9), a second cover 56 (the same as that in the FIG. 9), a washer 57 (the same as that in the FIG. 9), a retainer (such as plum-blossom-shaped washer) 58 (the same as that in the FIG. 9) and a first cover 59 (FIG. 2).

Figure 19:
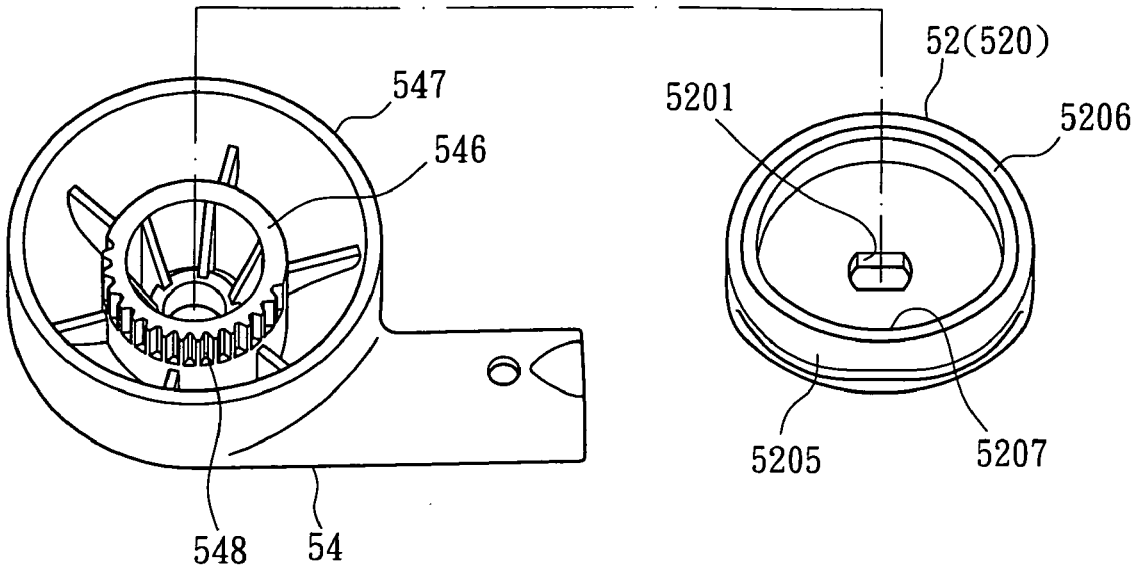
FIG. 19 is an exploded prospective view illustrating the output member and transmitting assembly shown in the FIG. 18.

As shown in the FIG. 19, the transmitting assembly 52 includes a substantially cap-shaped first friction piece 520. The first friction piece 520 has a first wall 5205 with a larger curvature radius, a second wall 5206 with a smaller curvature radius, a pair of parallel fifth planes 5201 formed the central orifice thereof, and a first friction plane 5207 (functioning as a first rough face) situated at the inner side of the first wall 5205. In addition, the first wall 5205 and the second wall 5206 are joined with each other to form a closed loop. The first friction face 5207 is made of rubber or a rubber pad.

The output member 54 includes an inner first bush 546, an outer second bush 547 substantially concentric with the first bush 546, and a second friction face 548 formed on the lower half outer portion of the first bush 546 and functioning as a second rough face. The output member 54 in the third preferred embodiment additionally has the friction function the same as that of the second friction piece 522 in the first and second embodiments.

The curvatures (or curvature radiuses) of the first wall 5205, the second wall 5206, the first bush 546 and the second bush 547 are different from one another.

Assembling

Figure 20:
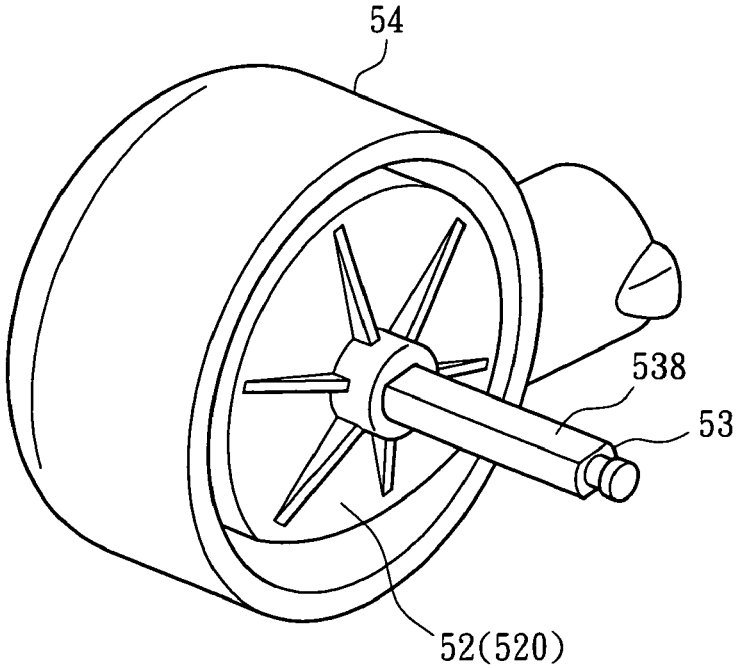
FIG. 20 is an assembled prospective view of the first shaft, output member and transmitting assembly shown in the FIG. 18.

As shown in the FIGS. 18, 19 and 20, at first, the first friction face 5207 of the first friction piece 520 is substantially aligned with the second friction face 548 of the output member 54. Then, the first and second walls 5205, 5206 of the first friction piece 520 are put into a space between the first and second bush 546, 547 of the output member 54. Next, the first shaft 53 is sequentially inserted into the central orifices of the output member 54 and the first friction piece 520 to the extent that the first plane 538 of the first shaft 53 faces the fifth plane 5201 of the first friction piece 520. At this time, the first friction face 5207 of the first friction piece 520 frictionally contacts the second friction face 548 of the output member 54. Thereafter, the subassembly described above is mounted to base 50 and the driving assembly 51, where the mounting processes are the same as those in the second preferred embodiments.

Operation and Effect

Figure 21:
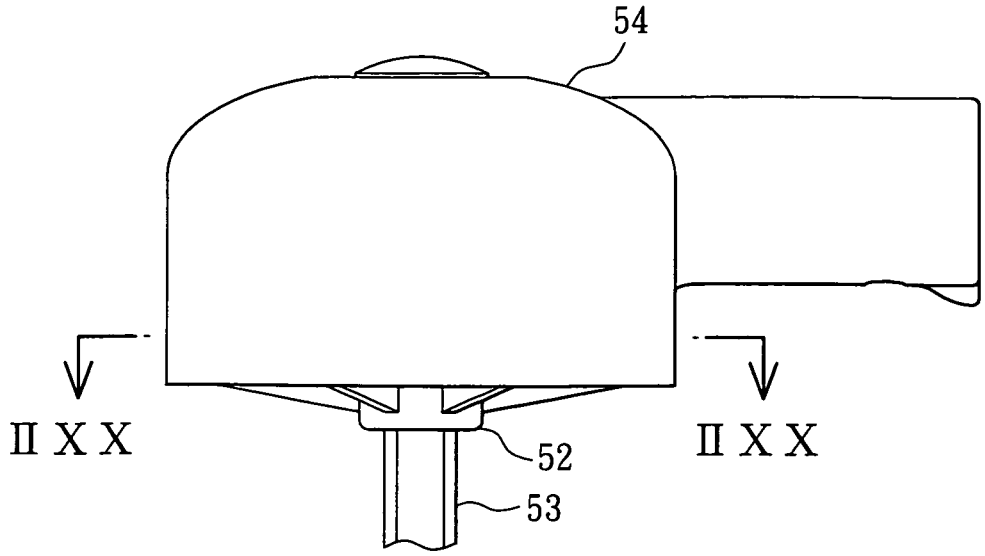
FIG. 21 is a side view of the FIG. 20.
Figure 22:
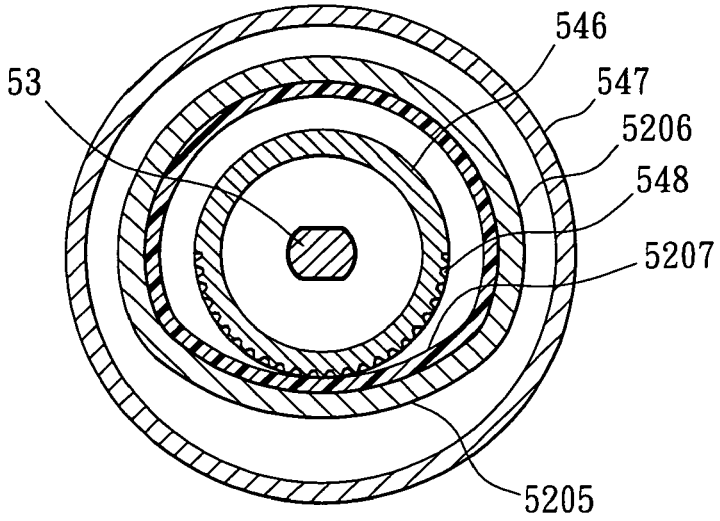
FIG. 22 is a sectional view taken along line XXII-XXII in the FIG. 21.

As shown in FIGS. 18, 21 and 22, when one of the electric switches 590 (FIG. 2) is pressed, the movement of the driving assembly 51 is transmitted to the first shaft 53 to make the first shaft 53 rotate in a predetermined angular range. Because the first plane 538 of the first shaft 53 abuts against the fifth plane 5201 of the first friction piece 520, the first shaft 53 will co-rotate with the first friction piece 520 and cannot rotate alone relative to the first friction piece 520. Furthermore, since the first friction face 5207 frictionally contacts the second friction face 548, the first friction piece 520 will move together with the output member 54 when the load on the second frame 4 is smaller than the friction force between the first friction face 5207 and the second friction face 548. Hence, the second frame 4 can be swung by the output member 54.

On the contrary, when the load on the second frame 4 is larger than the friction force between the first friction face 5207 and the second friction face 548, then the first friction piece 520 will rotate relative to the output member 54. Therefore, although the driving assembly 51 continuously cooperates with the first shaft 53 and the first friction 520, the output member 54 and the second frame 4 are still stationary. Because the actuator 510 is kept in normally operating state at this time, it will not break down due to overload.

The Fourth Preferred Embodiment

Figure 23:
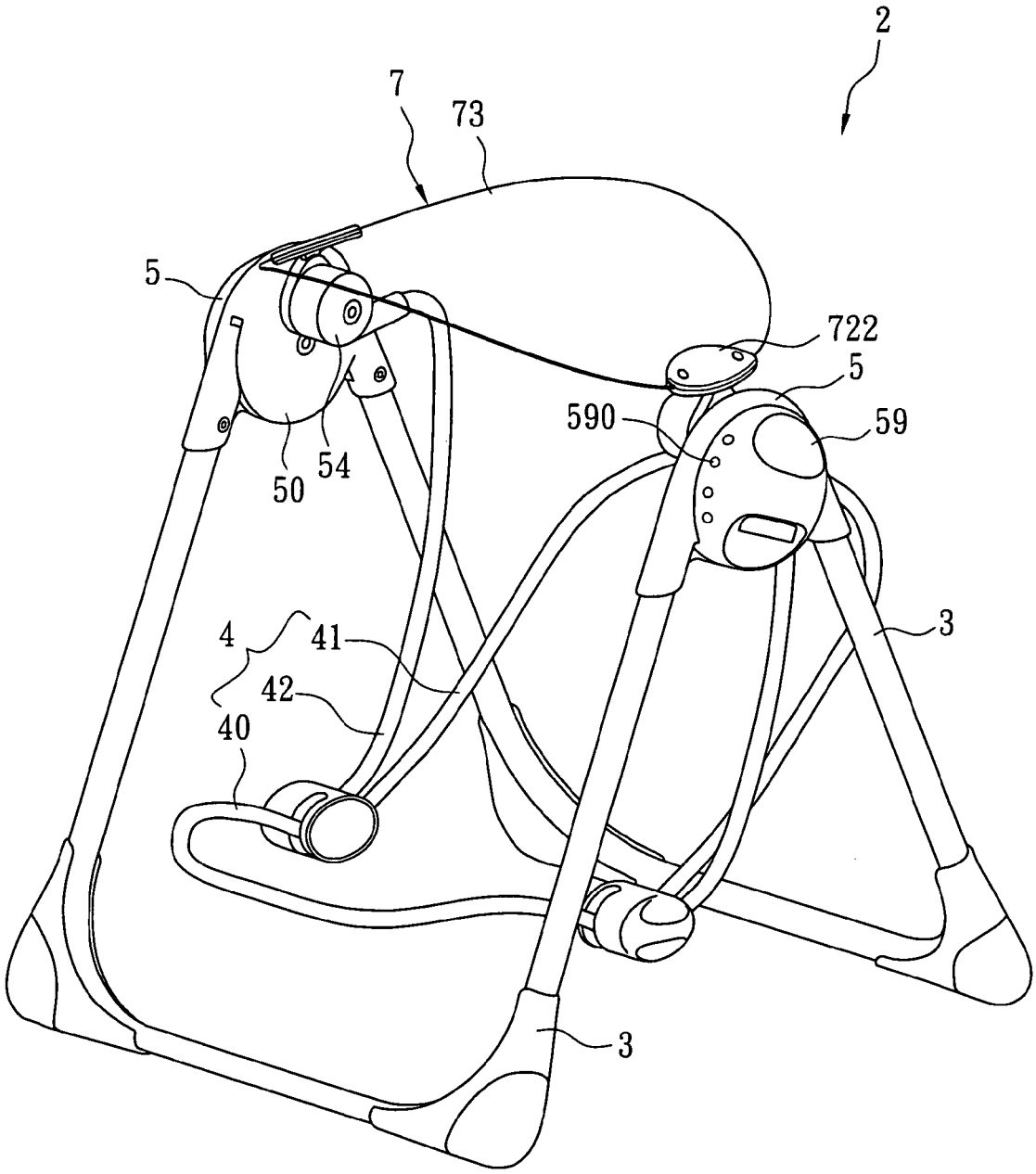
FIG. 23 is an assembled prospective view illustrating a swing apparatus for children according to the fourth embodiment of the present invention.

As shown in the FIG. 23, the swing apparatus 2 for children according to the fourth preferred embodiment, which is more similar to the second embodiment, of the present invention comprises a first frame 3, a second frame 4, an oscillating device 5 and a shielding device 7. The first frame 3 may include two U-shaped frame bodies. The oscillating device 5 connects the first frame 3 with the second frame 4.

The second frame 4 is similar to that described in the first preferred embodiment (FIG. 2).

Figure 24:
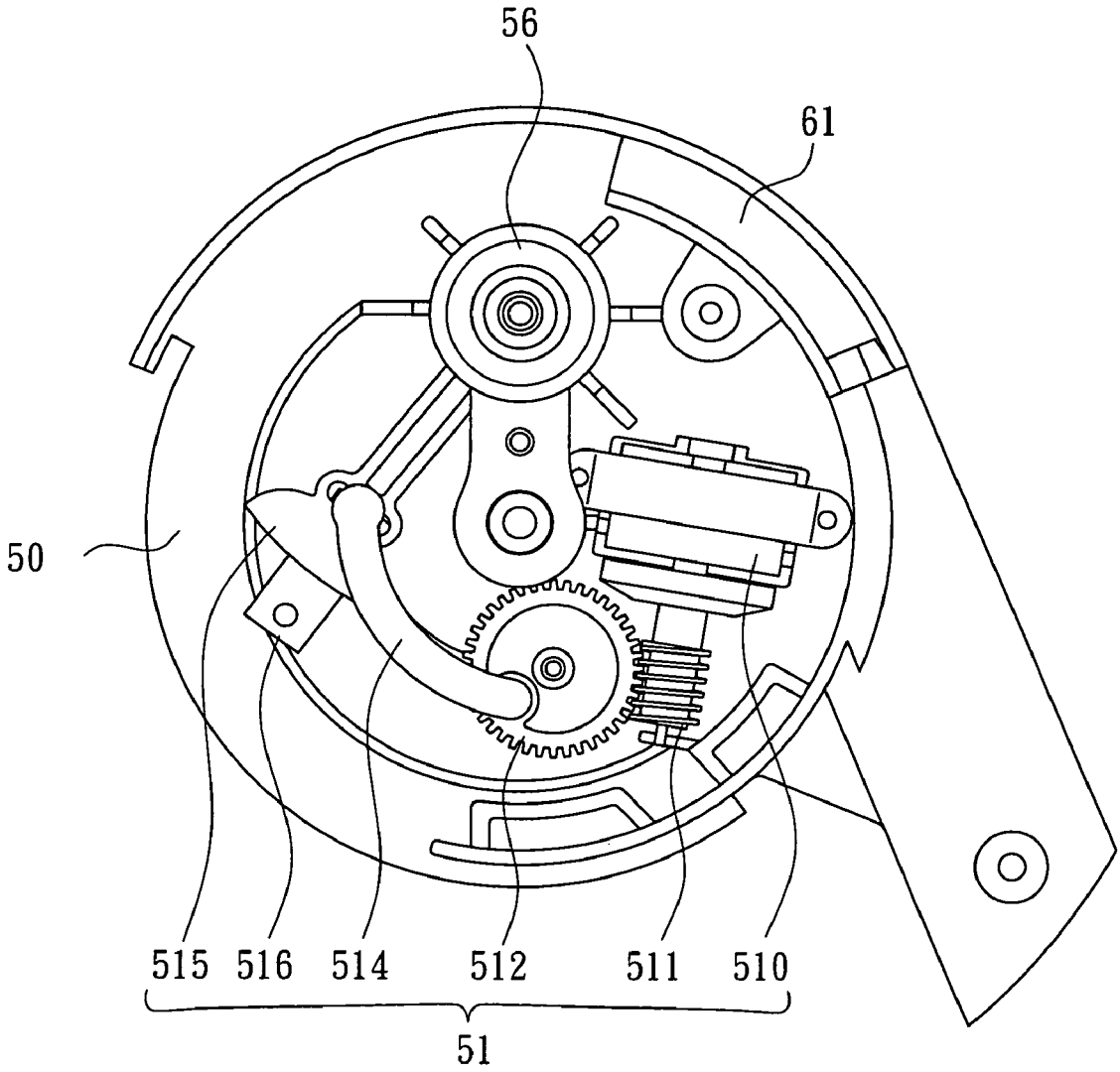
FIG. 24 is a front view illustrating the oscillating device, in which the first cover is not shown, in one side of the swing apparatus for children according to the fourth embodiment of the present invention.
Figure 25:
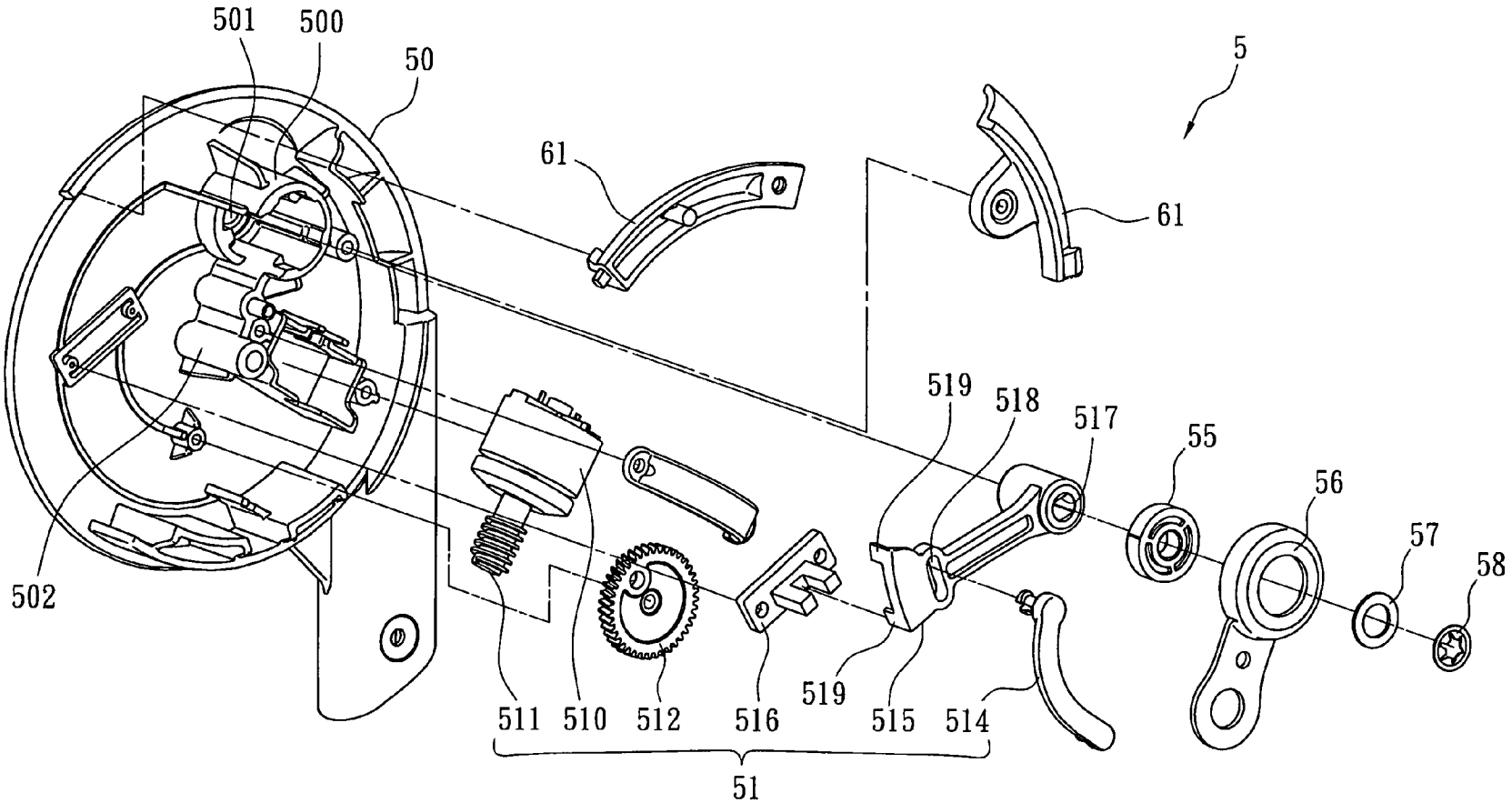
FIG. 25 is an exploded perspective view illustrating the driving assembly of the oscillating device in one side of the swing apparatus for children according to the fourth embodiment of the present invention.
Figure 26:
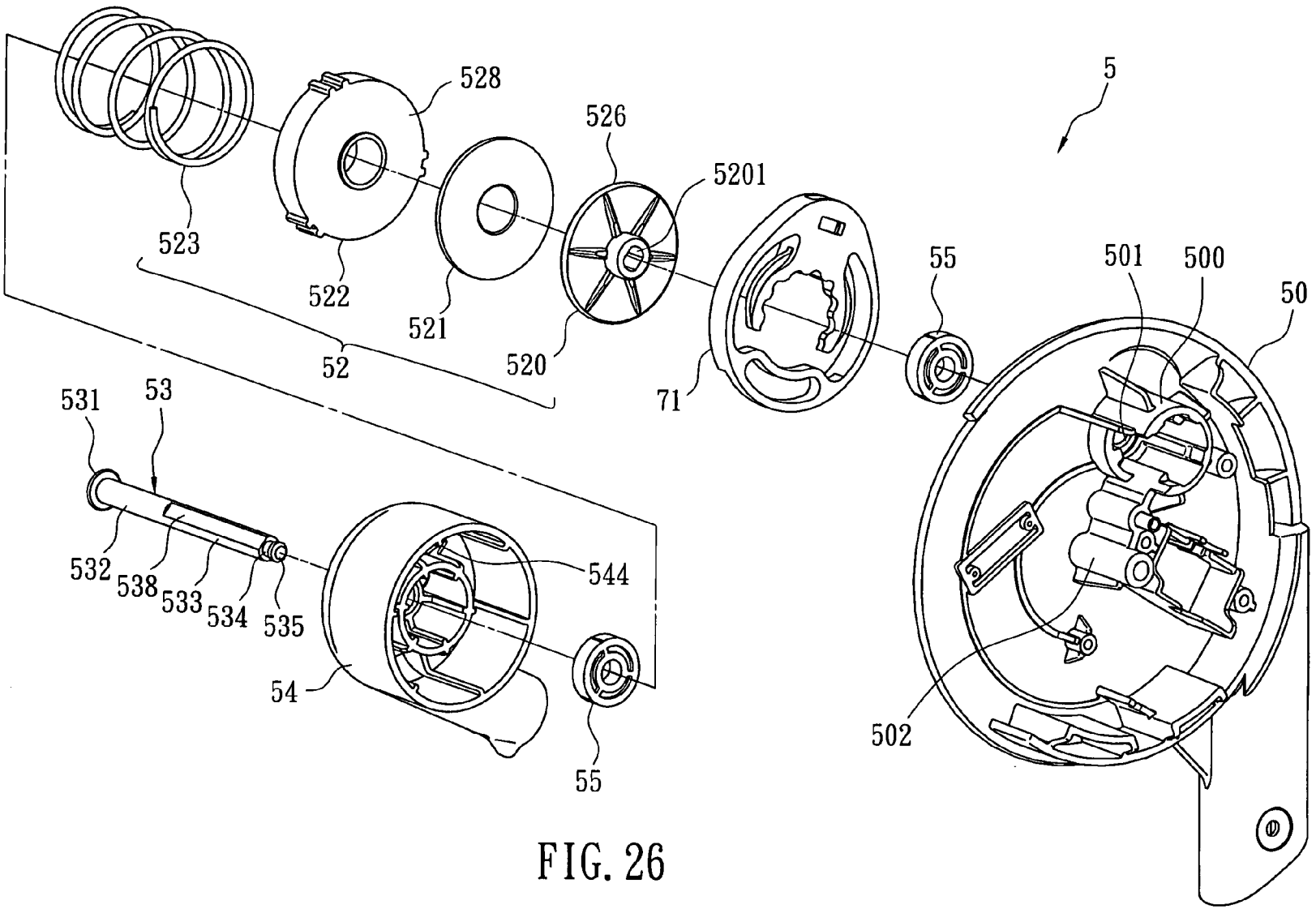
FIG. 26 is an exploded perspective view illustrating the transmitting assembly of the oscillating device in one side of the swing apparatus for children according to the fourth embodiment of the present invention.

As shown in the FIGS. 24, 25 and 26, The oscillating device 5 includes a base 50, a driving assembly 51, a transmitting assembly 52, a first shaft 53, an output member 54, three supporting pieces (such as bearings) 55, a second cover 56, a washer 57, a retainer (such as a plum-blossom-shaped washer) 58, a first cover 59 (FIG. 23) and two sealing pieces 61.

The base 50 has a cuff 500 with about three-fourth circle near upper end, a hole 501 at the center of the circle, an annulus 503 (FIG. 28) formed on another side opposite to the side with the cuff 500, and a plurality of bulges 504 (FIG. 28) extending away from the outer surface of the annulus 503.

As shown in the FIG. 25, the driving assembly 51 further includes an actuator (such as a motor) 510 fixed to the base 50, a driver (such as a worm) 511 connected to or used as the rotor of the actuator 510, a follower (such as a worm gear) 512 engaged with the driver 511, a first link 514 pivotally connected to the follower 512, a second link 515 pivotally connected to the first link 514, and a sensor 516 installed near the joint where the first link 514 pivotally connects with the second link 515. The second link 515 has two fingers 519 extending from the joint and a trough 518 near the joint for pivotally connecting with the first link 514. The second link 515 at another end thereof has a bore and two opposite sixth planes 517 within the bore.

As shown in the FIG. 26, the transmitting assembly 52 further includes a first friction piece 520, a packing 521, a second friction piece 522 and an elastic piece (such as a spring) 523, which are sequentially distributed.

The first shaft 53 is similar to that described in the second preferred embodiments (FIG. 9).

The first friction piece 520 includes two opposite fifth planes 5201 formed in the central orifice thereof and a first rough face 526 formed on one side face thereof. The second friction piece 522 includes a second rough face 528 formed on one side face thereof, a plurality of flanges 5222 (FIG. 10) extending from opposite side thereof and distributed in a ring shape, and a plurality of slots 5223 (FIG. 10) respectively defined by any two adjacent flanges 5222.

Figure 27:
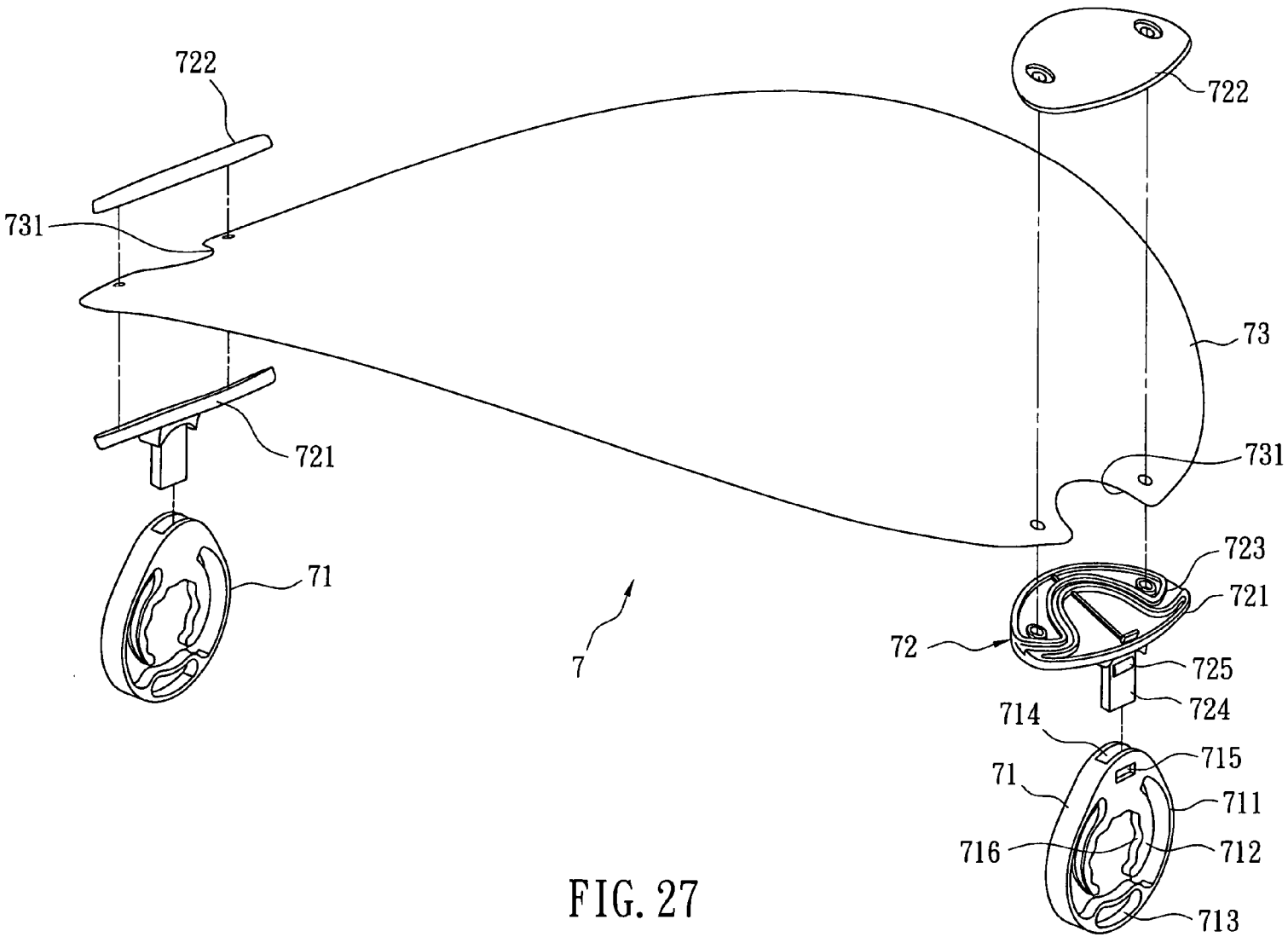
FIG. 27 is an exploded perspective view illustrating the shielding device shown in the FIG. 23.

As showing in the FIG. 27, the shielding device 7 includes a gripper 71, a holder 72 and a canopy 73. The canopy 73 has two cutouts 731 respectively formed at two opposite ends thereof.

The gripper 71 has a ring-like housing 711, a port 714 formed in one end of the housing 711, a window 715 communicating with the port 714, two gripping portions 712 extending inwards from the end of the housing 711, a plurality of notches 716 formed on one side of each gripping portions 712, and a curved flute 713 formed at another end of the housing 711.

The holder 72 has a first holding piece 721, a second holding piece 722, a stiffener 723 formed on the top face of the first holding piece 721, a plug 724 extending away from the bottom face of the first holding piece 721, and a bump 725 formed on the side face of the plug 724.

Assembling of the Oscillating Device

Figure 28:
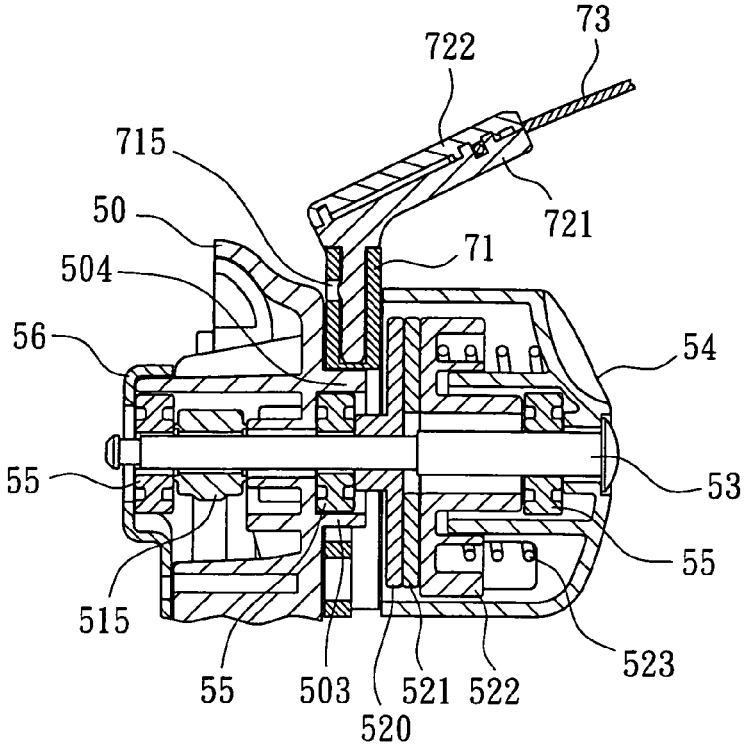
FIG. 28 is a partially sectional assembled view illustrating the oscillating device in one side of the FIG. 23.

As shown in the FIGS. 26 and 28, at first, the first shaft 53 is inserted into the output member 54 through the central orifice thereof. Next, the first supporting piece 55, the elastic piece 523, the second friction piece 522, the packing 521, the first friction piece 520 and the gripper 71 are sequentially sleeved on the first shaft 53 such that two ends of the elastic piece 523 respectively urge against the output member 54 and the second friction piece 522 at its side with the flanges 5222. Thereafter, the first shaft 53 in the subassembly described above is inserted into the hole 501 of the base 50 to the extent that the output member 54, the first supporting piece 55, the elastic piece 523, the second friction piece 522, the packing 521, the first friction piece 520 and the gripper 71 are positioned at one side of the base 50 while part of the third section 533, the fourth section 534 and the fifth section 535 of the first shaft 53 are situated at another side of the base 50 and received within the cuff 500.

As shown in the FIGS. 24, 25 and 28, subsequently, the second supporting piece 55, one end of the second link 515 with the sixth plane 517, the third supporting piece 55, the cap 561 of the second cover 56, the washer 57 and the retainer 58 are sequentially sleeved on the first shaft 53. Among the elements that are mounted on the first shaft 53, except that the output member 54, the first supporting piece 55, the elastic piece 523, the second friction piece 522 and the packing 521 are sleeved on the second section 532 of the first shaft 53 and the retainer 58 clips the first shaft 53 at the fourth section 534, the others are substantially sleeved on the first shaft 53 at the third section 533. In addition, the pillar 502 of the base 50 is accommodated within the aperture 563 of the second cover 56.

As shown in the FIGS. 25, 26 and 28, among the elements that are mounted on the first shaft 53, only the second link 515 with the sixth plane 517 and the first friction piece 520 with the fifth plane 5201 abut against the first plane 538 of the first shaft 53. Accordingly, the first shaft 53 will always move together with the second link 515 as well as the first friction piece 520. As far as the other elements mounted on the first shaft 53, because they have no planes to abut against the first plane 538 of the first shaft 53, the first shaft 53 can rotate relative to them.

As shown in the FIGS. 24 and 25, on the other hand, the sensor 516 and actuator 510 are respectively secured to the base 50. After that, the follower 512 is pivotally connected to the base 50 and engaged with the driver 511. Then, two ends of the first link 514 are pivotally connected respectively to a side face of the follower 512 and within the trough 518 of the second link 515.

Moreover, the sealing pieces 61, which reduce the clearance between the base 50 and the first cover 59, are mounted respectively on the base 50 and the first cover 59. The first cover 59 with the electric switches 590 is installed to the base 50 and secured to the pillar 502. The assembling about the oscillating device 5 in the swing apparatus 2 for children is now accomplished.

Assembling of the Shielding Device

As shown in the FIG. 27, the plugs 724 of the first holding pieces 721 are respectively inserted into the ports 714 of the grippers 71 so that the bumps 725 on the plugs 724 are respectively accommodated within the windows 715 of the grippers 71. Next, two ends of the canopy 73 are respectively set on the first holding pieces 721 so that the stiffener 723 on the first holding piece 721 are received within the cutouts 731 of the canopy 73. After the second holding pieces 722 are placed on the canopy 73 near the cutouts 731, the second holding piece 722, the canopy 73 and the first holding piece 721 are fixed together by a fastener (not shown) such as a screw or rivet. The shielding device 7 in the swing apparatus 2 for children is thus completed and the shielding device 5 is pivotally mounted on the oscillating device 5 at the same time. Alternatively, the second holding piece 722 can be omitted and the canopy 73 is directly secured onto the first holding piece 721. Alternatively, the holder 72 and the gripper 71 may be integrally formed.

As shown in the FIGS. 23 and 2, one swing apparatus 2 may be alternatively equipped with two different oscillating devices 5 at two sides thereof. One of the oscillating devices 5 has been described above. Another oscillating device 5 may not includes the driving assembly 51 (FIG. 9) and the transmitting assembly 52 (FIG. 24) but does includes a base 50 and a second shaft 53' different from those described above. As shown in the FIG. 29, the first section 531 of the second shaft 53' is bent to be a U shape relative to the second section 532. As to the base 50, it may further include two blockers 506 extending away from the cuff 500 and spaced apart at a predetermined angle, such as 30 degrees.

Operation and Effect

As shown in the FIGS. 25 and 26, when one of the electric switches 590 (FIG. 23) is pressed, electric current flows through electric circuit (not shown) to start the actuator 510. The movement of the actuator 510 is sequentially transmitted to the driver 511, the follower 512, the first link 514, the second link 515 and the first friction piece 520. In the meantime, the follower 512 continuously rotates in one direction while the first friction piece 520 can only repeatedly oscillates within a predetermined angular range.

Furthermore, since the first rough face 526 of the first friction piece 520 and the second rough face 528 of the second friction piece 522 respectively face two sides of the packing 521, the first friction piece 520 and the second friction piece 522 will tightly abut respectively against the two side faces of the packing 521 due to elastic force of the elastic piece 523. Consequently, the oscillating movement of the first friction piece 520 can be transmitted to the packing 521 and further to the second friction piece 522 by means of the friction forces existing on the faces contacting each other. When the load on the second frame 4 is smaller than the friction force in the transmitting assembly 52, the first friction piece 520, the packing 521 and the second friction piece 522 shall not rotate relatively one another. Therefore, the movement of the first friction piece 520 can be transmitted to the second friction piece 522. Furthermore, because the ribs 544 of the output member 54 are respectively accommodated within the slots 5223 on another side face of the second friction piece 522 and almost abut against the flanges 5222 (FIG. 10), the movement of the second friction piece 522 can be transmitted to the output member 54.

The output member 54 can rotate relative to the base 50. The oscillation movement of the output member 54 can be transmitted to the second frame 4 via the hanger arm 42 in order to make the second frame 4 and the sitting device secured thereon swing back and forth within a predetermined angular range.

When the sitting device is swung to a higher position where the sitting device is topmost in the stroke, one of two fingers 519 will be aligned with the sensor 516 and thus the sensor 516 senses the finger 519. The sensor 516 then sends a signal to a circuit (not shown) installed within the oscillating device 5 so as to control the actuator 510 outputting a smaller torque. This is because the sitting device at the topmost position is going to be swung downwards by its gravity so that a larger torque outputted from the actuator 510 is unnecessary. On the contrary, when the sitting device is swung to a lower position in the stroke, both of the fingers 519 do not aligned with the sensor 516 and thus the sensor 516 does not sense any finger 519. Thus, the sensor 516 sends another signal to the circuit (not shown) installed within the oscillating device 5 so as to control the actuator 510 outputting a larger torque. This is because the sitting device at the lower position is going to be swung upwards and thus needs external force so that a larger torque outputted from the actuator 510 is necessary. The fingers 519, sensor 516 and related controlling circuit are helpful to save the electrical power and extend the lifespan of the battery.

Figure 30:
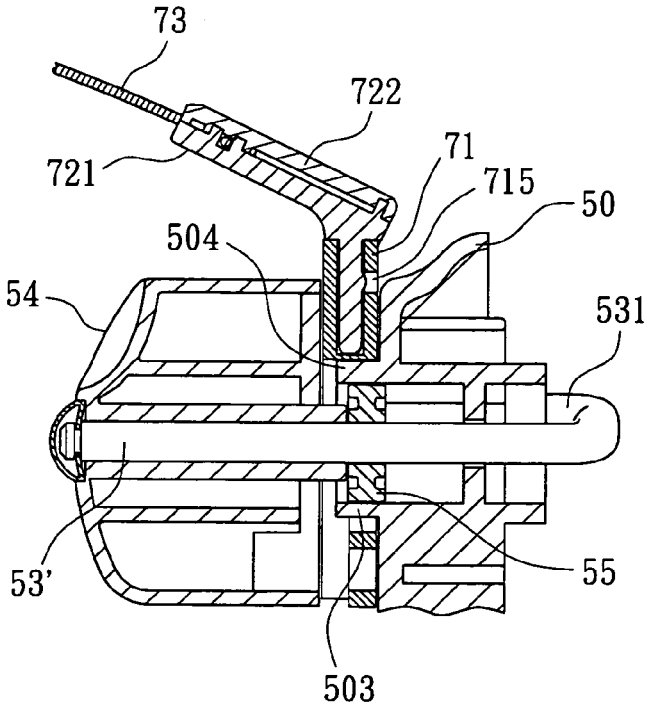
FIG. 30 is a partially sectional assembled view illustrating the oscillating device in another side of the FIG. 23.
Figure 29:
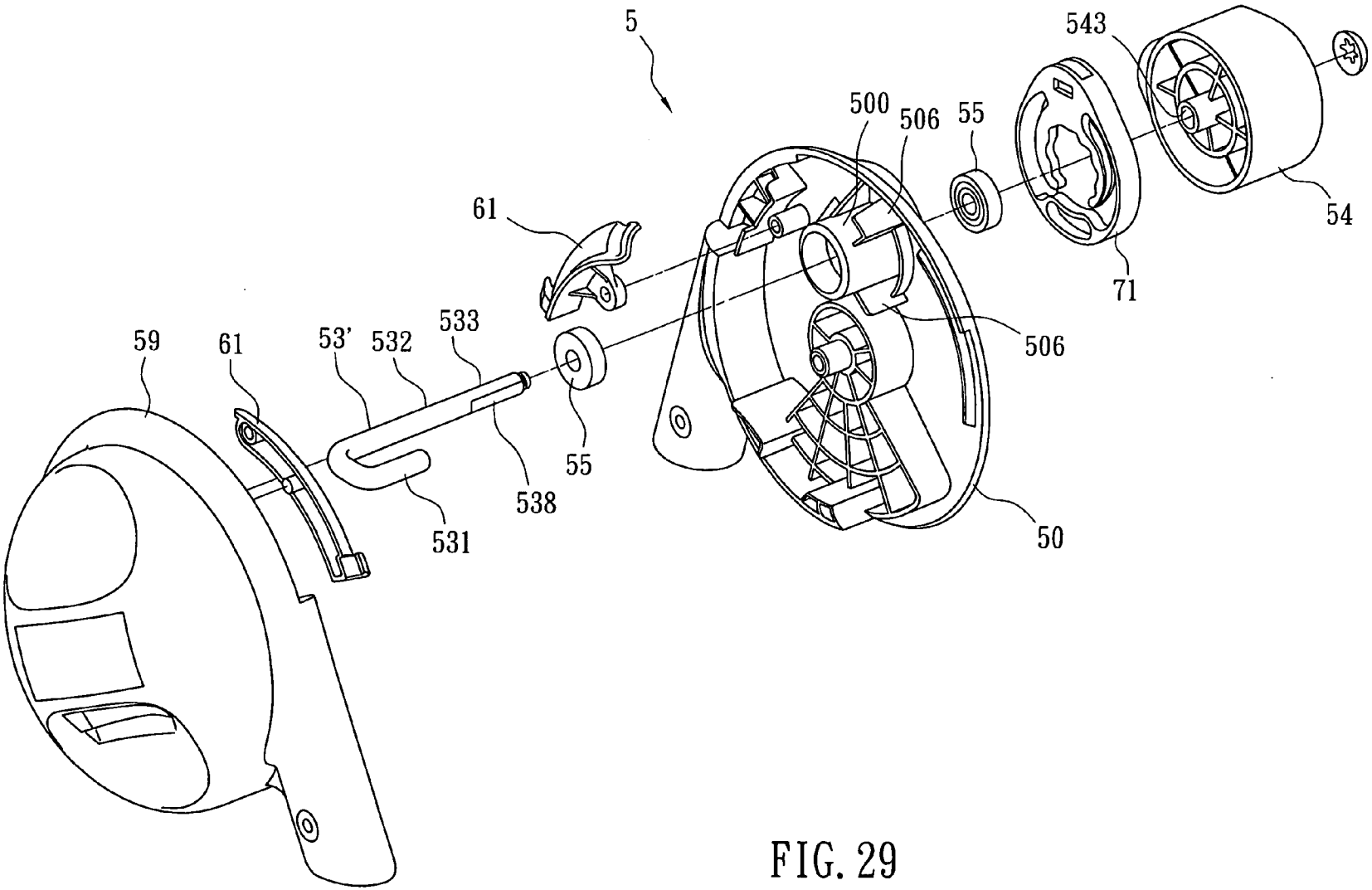
FIG. 29 is an exploded perspective view illustrating the driving assembly of the oscillating device in another side of the swing apparatus for children according to the fourth embodiment of the present invention.
Figure 31:
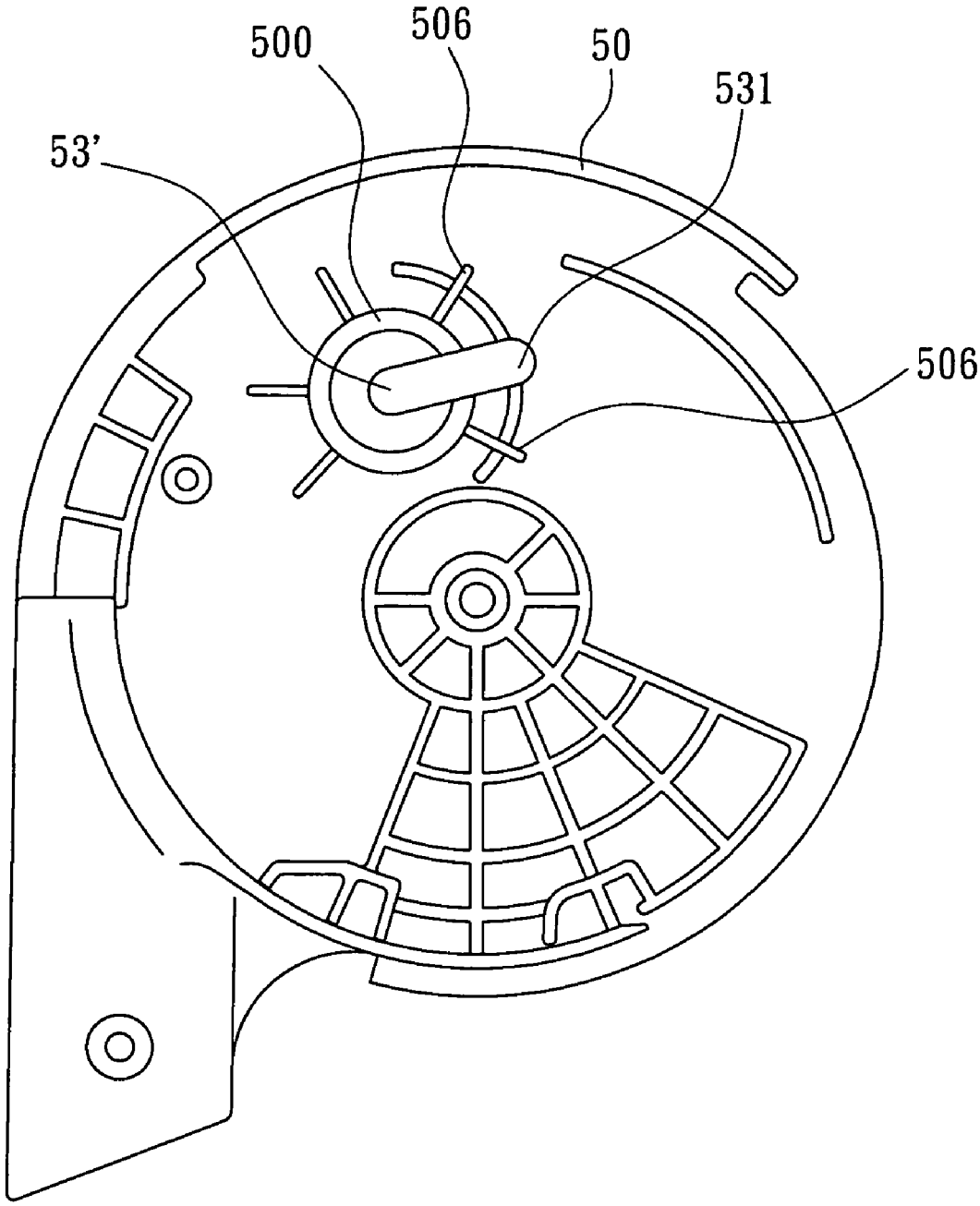
FIG. 31 is an assembled front view illustrating the base and the second shaft in the FIG. 29.

As shown in the FIGS. 29, 30 and 31, alternatively, the blockers 506 of the base 50 situated at another side of the swing apparatus 2 can stop the movement of the second shaft 53' by abutting the U-shaped first section 531 against either of the blockers 506. Because the first plane 538 of the second shaft 53' is engaged with the third plane 543 of another output member 54, the movement of the another output member 54, together with the second shaft 53', can be restricted by the blockers 506. Hence, The U-shaped first section 531 and the blockers 506 have the function to avoid the first and second frame 3, 4 from being swung over the predetermined range.

As shown in the FIGS. 27 and 28, in another aspect, because the annulus 503 of the base 50 is received within the gripping portion 712 of the gripper 71 and the bulges 504 on the annulus 503 are situated within the notches 716 of the gripper 71, the gripper 71 clips on the annulus 503 of the base 50 to make the canopy 73 adjustably mounted on the base 50 in a predetermined angle. When the adjustment about the angle of the canopy 73 relative the base 50 is necessary, the users only need to do is to rotate the holders 72. Because the gripping portions 712 of the grippers 71 are elastically deformable, the bulges 504 on the annulus 503 can overcome the gripping force of the gripping portions 712 to change their relative positions and be received within another set of notches 716. Therefore, the canopy 73 is situated on the base 50 in another angle. If the canopy 73 is unnecessary, the user can press the bump 725 to release the holder 72 from the gripper 71 and further detach the canopy 73 from the base 50.

This invention has been disclosed in terms of specific embodiments. It will be apparent that many modifications can be made to the disclosed structures without departing from the invention. Therefore, it is the intent of the appended claims to cover all such variations and modifications that are within the breadth and scope of this invention.

What is claimed is:

1. An oscillating device for children's swing apparatus comprising:

a base;

a driving assembly mounted to the base;

an output piece pivotally connected to the base via a first shaft, the driving assembly operably driving the output piece to oscillate relative to the base; and a transmitting assembly which includes a first friction piece, the first friction piece being coupled to the base by the first shaft, the first friction piece being driven to oscillate back and forth by the driving assembly, wherein a magnitude of a friction force between the first friction piece and the output piece determines whether the first friction piece moves relative to or together with the output piece.

2. The oscillating device used in combination with a swing apparatus as claimed in the claim 1, wherein the transmitting assembly includes a second friction piece which is for cooperating the output piece and an elastic piece which urges against one of the first friction piece and the second friction piece; the first friction piece moves relative to or together with the second friction piece depending on a magnitude of a friction force therebetween.

3. The oscillating device used in combination with a swing apparatus as claimed in the claim 2, wherein the first friction piece includes a first rough face and the second friction piece includes a second rough face; the first rough face opposingly facing the second rough face.

4. The oscillating device used in combination with a swing apparatus as claimed in the claim 3, wherein the transmitting assembly further includes a packing with two opposite side faces which respectively contact the first rough face and the second rough face.

5. The oscillating device used in combination with a swing apparatus as claimed in the claim 2, wherein the first shaft passes through the transmitting assembly and has a first plane; the second friction piece further includes a third central orifice adapted to the first plane; the first shaft is received in the third central orifice such that the second friction piece and the first shaft move together.

6. The oscillating device used in combination with a swing apparatus as claimed in the claim 5, wherein the first shaft includes a second plane; the output piece includes a fourth central orifice adapted to the second plane; the first shaft is received in the fourth central orifice such that the first shaft and the output piece move together.

7. The oscillating device used in combination with a swing apparatus as claimed in the claim 6, wherein the driving assembly further includes an actuator which is secured to the base, a driver which is connected to the actuator, a follower which is connected to the driver, and a link which connects the follower to the first friction piece; the elastic piece urges against the first friction piece.

8. The oscillating device used in combination with a swing apparatus as claimed in the claim 1, wherein the first friction piece has a first friction face; the output piece has a second friction face which contacts the first friction face, the first friction face and the second friction face are cambered surfaces with different curvatures.

9. The oscillating device used in combination with a swing apparatus as claimed in the claim 1, wherein the first shaft passes through the transmitting assembly and has a first plane; the first friction piece further includes a first central orifice adapted to the first plane; the first shaft is received in the first central orifice such that the first friction piece and the first shaft move together.

10. The oscillating device used in combination with a swing apparatus as claimed in the claim 9, wherein the driving assembly includes an actuator which is secured to the base, a driver which is connected to the actuator, a follower which is connected to the driver, and two links which are pivotally connected with each other and respectively connected to the follower and the first shaft; one of the two links includes a second central orifice adapted to the first plane; the first shaft is received in the second central orifice such that the one of the two links and the first shaft move together.

11. A swing apparatus for children comprising a first frame, a second frame, and an oscillating device connecting the first frame with the second frame, the oscillating device includes:

a base connected to the first frame;

a driving assembly mounted to the base;

an output piece pivotally connected to the base via a first shaft; and a transmitting assembly further including a first friction piece which is driven to oscillate back and forth by the driving assembly, the first friction piece being coupled to the base by the first shaft;

wherein a magnitude of a friction force between the first friction piece and the output piece determines whether the first friction piece moves relative to or together with the output piece, and the driving assembly causes the second frame to swing relative to the first frame.

12. The swing apparatus for children as claimed in the claim 11, wherein the transmitting assembly further includes a second friction piece which is for cooperating the second frame and an elastic piece which urges against one of the first friction piece and the second friction piece; the first friction piece moves relative to or together with the second friction piece depending on a magnitude of a friction force therebetween.

13. The swing apparatus for children as claimed in the claim 11, wherein the swing apparatus further comprises a shielding device which is pivotally mounted to the oscillating device.

14. The swing apparatus for children as claimed in the claim 11, wherein the first shaft passes through the transmitting assembly and has a first plane; the first friction piece further includes a first central orifice adapted to the first plane; the first shaft is received in the first central orifice such that the first friction piece and the first shaft move together.

15. The swing apparatus for children as claimed in the claim 11, wherein the oscillating device includes a second shaft and another base; the second shaft has a bent first section and the another base has two blockers; the bent first section moves between the two blockers so that the moving range of the second shaft and the output piece is restricted.

16. The swing apparatus for children as claimed in the claim 11, wherein the driving assembly includes a sensor which is secured to the base, an actuator which is secured to the base for supplying power to the transmitting assembly, a driver which is connected to the actuator, a follower which is connected to the driver, and a link device which are pivotally connected to the follower and a first shaft which passes through the transmitting assembly, the sensor is configured to sense the movement of the link device so as to control the output of the actuator.

17. A swing apparatus for children comprising:

a first frame;

a second frame; and an oscillating device connecting the first frame with the second frame, the oscillating device includes a base connected to the first frame, a driving assembly mounted to the base, an output piece secured to the second frame pivotally connected to the base, a transmitting assembly mounted between the driving assembly and the output piece, and a first shaft connected to the driving assembly and passing through the transmitting assembly;

wherein the transmitting assembly includes a first friction piece secured to the first shaft, and a second friction piece un-rotatably connected to output piece; when the first shaft is driven to rotate relative to the base by the driving assembly, the first friction piece is moved together with the first shaft, and the second friction piece is driven to rotate relative to the base by the friction between the first friction piece and the second friction piece so that the second frame is driven to oscillate back and forth relative to the first frame.

18. A swing apparatus for children as claimed in claim 17, wherein the first friction piece includes a first rough face and the second friction piece includes a second rough face; the transmitting assembly further includes a packing with two opposite side faces which respectively contact the first rough face and the second rough face.

* * * * *